US010220535B2

(12) United States Patent
Schmier, II et al.

(10) Patent No.: US 10,220,535 B2
(45) Date of Patent: Mar. 5, 2019

(54) SYSTEMS AND METHODS OF SEPARATING TUBING SLEEVES FROM A TUBING HOLDER

(71) Applicant: The Boeing Company, Chicago, IL (US)

(72) Inventors: Mark A. Schmier, II, Mesa, AZ (US); David J. Delany, Gilbert, AZ (US)

( * ) Notice: Subject to any disclaimer, the term of this patent is extended or adjusted under 35 U.S.C. 154(b) by 598 days.

(21) Appl. No.: 14/705,875

(22) Filed: May 6, 2015

(65) Prior Publication Data

US 2015/0231792 A1 Aug. 20, 2015

Related U.S. Application Data

(63) Continuation-in-part of application No. 13/907,682, filed on May 31, 2013, which is a continuation-in-part
(Continued)

(51) Int. Cl.
*B26D 3/16* (2006.01)
*B26D 1/14* (2006.01)
(Continued)

(52) U.S. Cl.
CPC ..... *B26D 3/16* (2013.01); *B26D 1/14* (2013.01); *B26D 1/157* (2013.01); *B26D 1/22* (2013.01);
(Continued)

(58) Field of Classification Search
CPC ..... B26D 3/16; B26D 3/161; B26D 3/162; B26D 3/166; B26D 3/167; B26D 3/168;
(Continued)

(56) References Cited

U.S. PATENT DOCUMENTS 1,969,696 A 8/1934 Newton
3,056,324 A 10/1962 Lach
(Continued)

FOREIGN PATENT DOCUMENTS

DE 102005044188 A1 4/2007
EP 2720006 A1 4/2014
(Continued)

OTHER PUBLICATIONS

Extended European Search Report for EP Application No. 15171223.9 from the European Patent Office dated Jan. 19, 2016, 7 pages.
(Continued)

*Primary Examiner* — Jason Daniel Prone
*Assistant Examiner* — Richard D Crosby, Jr.
(74) *Attorney, Agent, or Firm* — Toler Law Group, P.C.

(57) ABSTRACT

A method includes selecting a cutting wheel assembly of a plurality of cutting wheel assemblies of a cutting system. Each cutting wheel assembly includes a different number of cutting blades. The method includes using a feed system to feed tubing toward the cutting system. The method also includes using the cutting system to cut the tubing concurrently at a plurality of locations to separate one or more subsections of tubing. The plurality of locations corresponds to a particular number of cutting blades of the selected cutting wheel assembly.

13 Claims, 16 Drawing Sheets

Related U.S. Application Data of application No. 13/227,593, filed on Sep. 8, 2011, now Pat. No. 8,935,842.

(51) Int. Cl.
*B26D 1/157* (2006.01)
*B26D 1/22* (2006.01)
*B26D 7/06* (2006.01)

(52) U.S. Cl.
CPC ..... *B26D 7/0616* (2013.01); *Y10T 83/04* (2015.04); *Y10T 83/658* (2015.04); *Y10T 83/6648* (2015.04)

(58) Field of Classification Search
CPC ..... B26D 3/22; B26D 3/225; Y10T 83/637; Y10T 83/658; Y10T 83/6582; Y10T 83/6584
See application file for complete search history.

(56) References Cited

U.S. PATENT DOCUMENTS

| | | | | |
|---|---|---|---|---|
| 3,180,442 | A | 4/1965 | Pomeroy | |
| 3,238,825 | A | 3/1966 | Dearsley | |
| 3,312,053 | A | 4/1967 | Takamune et al. | |
| 3,314,339 | A | 4/1967 | Guffy et al. | |
| 3,406,851 | A | 10/1968 | Sundberg | |
| 3,522,971 | A | 8/1970 | Buschbom | |
| 3,894,731 | A | 7/1975 | Evans | |
| 3,985,852 | A | 10/1976 | Evans | |
| 4,034,450 | A | 7/1977 | Carlomagno et al. | |
| 4,083,268 | A | 4/1978 | Kober | |
| 4,095,926 | A * | 6/1978 | Paul | A21C 9/081 198/457.03 |
| 4,365,400 | A | 12/1982 | Carlomagno | |
| 4,451,965 | A | 6/1984 | Carlomagno | |
| 4,574,440 | A | 3/1986 | Wirth et al. | |
| 4,651,605 | A | 3/1987 | Dean, II | |
| 4,655,129 | A | 4/1987 | Wirth et al. | |
| 4,736,501 | A | 4/1988 | Fujimoto | |
| 4,865,895 | A | 9/1989 | Vlamings et al. | |
| 4,868,023 | A | 9/1989 | Ryan et al. | |
| 4,885,964 | A | 12/1989 | Nielsen et al. | |
| 5,021,111 | A | 6/1991 | Swenson | |
| 5,078,001 | A | 1/1992 | Bakermans | |
| 5,110,638 | A | 5/1992 | Vogdes et al. | |
| 5,307,940 | A | 5/1994 | Kanegae | |
| 5,425,307 | A * | 6/1995 | Rush | B26D 3/22 83/404.1 |
| 5,516,221 | A | 5/1996 | Lake | |
| 5,540,127 | A | 7/1996 | Binder et al. | |
| 5,651,286 | A | 7/1997 | Champion et al. | |
| 5,791,220 | A * | 8/1998 | Liao | B26D 1/285 83/303 |
| 5,865,085 | A | 2/1999 | Vollenweider | |
| 6,089,125 | A | 7/2000 | Cheng | |
| 6,334,253 | B1 | 1/2002 | Cheng | |
| 6,487,949 | B1 * | 12/2002 | Dharia | B26D 3/003 83/152 |
| 6,502,488 | B1 | 1/2003 | Taylor | |
| 6,612,216 | B2 * | 9/2003 | McGehee | B27B 5/36 83/425.4 |
| 6,875,304 | B2 | 4/2005 | Schanke et al. | |
| 7,100,486 | B2 * | 9/2006 | Akins | B26D 3/20 83/404.1 |
| 7,469,736 | B2 | 12/2008 | Fries et al. | |
| 7,735,404 | B2 | 6/2010 | Wilk | |
| 8,353,234 | B2 * | 1/2013 | Takama | A21C 3/10 426/503 |
| 8,910,553 | B2 * | 12/2014 | Catelli | B26D 1/46 83/418 |
| 2003/0219177 | A1 | 11/2003 | Salvaro | |
| 2005/0034818 | A1 | 2/2005 | Prindiville | |
| 2010/0319505 | A1 | 12/2010 | Celeste et al. | |
| 2011/0239840 | A1 | 10/2011 | Ohyabu et al. | |
| 2013/0061443 | A1 | 3/2013 | Fengler et al. | |
| 2015/0231792 | A1 * | 8/2015 | Schmier, II | B26D 3/16 83/423 |

FOREIGN PATENT DOCUMENTS

| | | |
|---|---|---|
| JP | S56-006317 | 1/1981 |
| JP | H10199348 | 7/1998 |

OTHER PUBLICATIONS

Non-Final Office Action, U.S. Appl. No. 13/907,682, dated Jul. 25, 2017, 15 pages.
Heat Shrink Cutter: Slice 135: BuyHeatShrink.com, retrieved from the Internet: http://www.buyheatshrink.com/wire-cutter/slice-135-heat-shrink-cutter.htm; 2006-2012 BuyHeatShrink.com, (3 pgs).
Model 6100 Heat Shrink Tubing Cutter, retrieved from the Internet: http://www.buyheatshrink.com/wire-cutter/JQ-6100-shrink-tubing-cutter.htm; 2006-2012 BuyHeatShrink.com, (3 pgs).
Slice Model 142-P Adhesive Heat Shrink Cutter; retrieved from the Internet: http://www.buyheatshrink.com/wire-cutter/slice-142-adhesive-heat-shrink-cutter.htm; 2006-2012 BuyHeatShrink.com, (5 pgs).
Canadian Examination Report for Application No. 2,788,232 dated May 11, 2018, 4 pgs.
Japanese Office Action for Application No. 2012-196906 dated Oct. 25, 2016, 4 pgs.
Japanese Office Action for Application No. 2012-196906 dated Jul. 5, 2016, 7 pgs.

* cited by examiner

SYSTEMS AND METHODS OF SEPARATING TUBING SLEEVES FROM A TUBING HOLDER

CLAIM OF PRIORITY

The present application is a continuation-in-part of and claims priority from co-pending U.S. patent application Ser. No. 13/907,682, entitled "Systems and Methods of Separating Tubing Sleeves from a Tubing Holder," which is a continuation-in-part of and claims priority from U.S. Pat. No. 8,935,842, entitled "Sleeve Removal Device," the contents of which are incorporated herein by reference in their entirety.

FIELD OF THE DISCLOSURE

The present disclosure is generally related to systems and methods of separating tubing sleeves from a tubing holder.

BACKGROUND

Heat shrink tubing may be utilized for many purposes, including wire and cable identification, insulation, or both. For example, short lengths (or sleeves) of heat shrink tubing may be attached to a tubing holder. The tubing holder may be fed to a printer to print information, such as wire identification information, on the heat shrink tubing. The tubing sleeves may be manually removed by an operator from between the spines of the tubing holder. For example, the tubing sleeves may be separated by hand or manually cut using a scissor or a knife. Each tubing sleeve may be manually positioned on a corresponding wire and heat may be applied to the tubing sleeve to shrink the tubing sleeve in place on the wire.

The manual separation of the tubing sleeves may use hand strength, finger strength, dexterity, and patience. In some applications, such as labeling a complex wiring harness, the manual separation process may be repeated tens or hundreds of times.

SUMMARY

In a particular embodiment, a method includes selecting a cutting wheel assembly of a plurality of cutting wheel assemblies of a cutting system. Each cutting wheel assembly includes a different number of cutting blades. The method includes using a feed system to feed a tubing toward the cutting system. The method also includes using the cutting system to cut the tubing concurrently at a plurality of locations to separate one or more subsections of tubing. The plurality of locations corresponds to a particular number of cutting blades of the selected cutting wheel assembly.

In another particular embodiment, an apparatus includes a cutting system and a feed system configured to feed a tubing toward the cutting system. The cutting system includes a plurality of cutting wheel assemblies, and each cutting wheel assembly includes a different number of cutting blades. The cutting system is configured to cut the tubing concurrently at a plurality of locations to separate one or more subsections of tubing. The plurality of locations corresponds to a particular number of cutting blades of a selected cutting wheel assembly of the plurality of cutting wheel assemblies.

In another particular embodiment, a method includes receiving input from an input device at a tubing cutter device. The method also includes, in response to the input, using a feed system of the tubing cutter device to advance a tubing by a distance toward a selected cutting wheel assembly of a plurality of cutting wheel assemblies of a cutting system of the tubing cutter device. The method further includes using the cutting system of the tubing cutter device to cut the tubing concurrently at a plurality of locations to separate one or more subsections of tubing. The plurality of locations corresponds to a particular number of cutting blades of the selected cutting wheel assembly of the plurality of cutting wheel assemblies. The method also includes dispensing the one or more subsections of tubing from the cutting system to an operator.

Thus, particular embodiments separate subsection(s) of tubing (e.g., tubing sleeves from a tubing holder). Automated separation of tubing subsections (e.g., separation of the tubing sleeves from the tubing holder) may improve efficiency and may reduce cost and effort associated with using the tubing.

The features, functions, and advantages that have been described can be achieved independently in various embodiments or may be combined in other embodiments, further details of which are disclosed with reference to the following description and drawings.

DETAILED DESCRIPTION

Systems and methods to separate subsection(s) of tubing (e.g., tubing sleeves from a tubing holder) are disclosed. The disclosed embodiments include a feed system and a cutting system. The feed system may advance the tubing holder to the cutting system. The cutting system may cut a section of tubing of the tubing holder at a plurality of locations to separate one or more subsections of tubing from the tubing holder. Each of the subsection(s) of tubing may correspond to a heat shrink tubing sleeve. The subsection(s) of tubing may be dispensed to an operator. The operator may use the heat shrink tubing sleeves to label wires, insulate wires, or both. Automated separation of the tubing sleeves from the tubing holder may improve efficiency and may reduce cost and effort associated with using the tubing sleeves.

Figure 1:
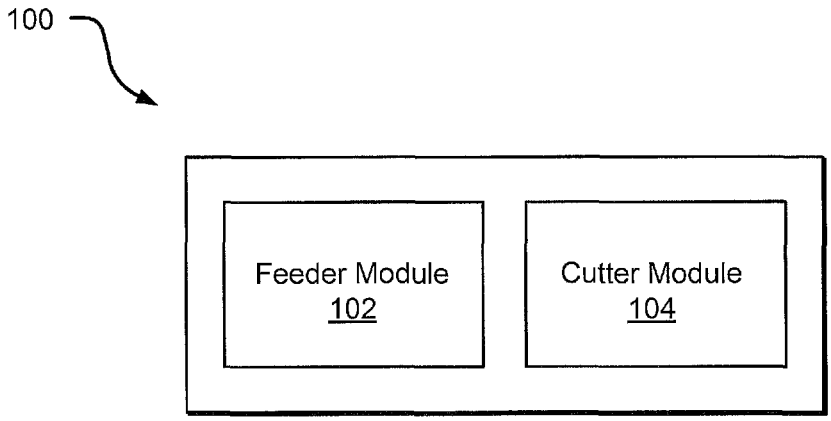
FIG. 1 is a block diagram of a particular embodiment of a system to separate tubing sleeves from a tubing holder.

Referring to FIG. 1, a block diagram of a particular embodiment of a system to separate tubing sleeves from a tubing holder is disclosed and generally designated 100. The system 100 may include a feeder module 102 (also referred to as a feed system) coupled to, or in communication with, a cutter module 104 (also referred to as a cutting system). During operation, the feeder module 102 may advance tubing (e.g., in a tubing holder) toward the cutter module 104. The cutter module 104 may cut the tubing at a plurality of locations to separate one or more subsections of tubing. As described further herein, the cutter module 104 may include a multiple-spindle blade cutting apparatus that includes a plurality of cutting wheel assemblies. Each of the cutting wheel assemblies may include a different number of blades (e.g., two, three, or four blades, among other alternatives) to separate different numbers of subsection(s) of tubing. In a particular embodiment, a particular cutting wheel assembly may be selected by rotating the multiple-spindle blade cutting apparatus to a particular position for performing cutting operations. The system 100 may dispense (e.g., substantially simultaneously with one another in the case of more than one subsection being separated) the subsection(s) from the cutter module 104 to an operator. In a particular embodiment, each of the one or more subsections may include wire designation markings for a particular wire. Operation of the system 100 is further described with reference to FIG. 7.

The system 100 may enable separation of tubing sleeves from a tubing holder. Automated separation of tubing sleeves from the tubing holder may reduce time, cost, and effort associated with separating tubing sleeves from a tubing holder.

FIGS. 2 and 3A-3C illustrate a particular embodiment of a tubing holder generally designated 200. The tubing holder 200 may be used by the system 100 of FIG. 1. The tubing holder 200 includes a first spine 202 parallel to a second spine 212. In another embodiment, the tubing holder 200 may include fewer or more than two spines. A plurality of sections of tubing (e.g., including a section of tubing 208) are coupled at intervals along the first spine 202 and along the second spine 212. For example, each of the plurality of sections of tubing may be attached at one end to the first spine 202 and at the other end to the second spine 212 using adhesive tape 204.

In an alternative embodiment, the plurality of sections of tubing may be coupled in another manner to a spine (e.g., the first spine 202, the second spine 212, or both) of the tubing holder 200. For example, the plurality of sections of tubing may be coupled to a plurality of ribs extending from the spine (e.g., the first spine 202, the second spine 212, or both). As another example, the plurality of sections of tubing may be glued to the spine (i.e., the first spine 202, the second spine 212, or both). The one or more sections may be coupled to the spine when the tubing holder 200 is prepared, manufactured, assembled, etc.

Figure 3A:
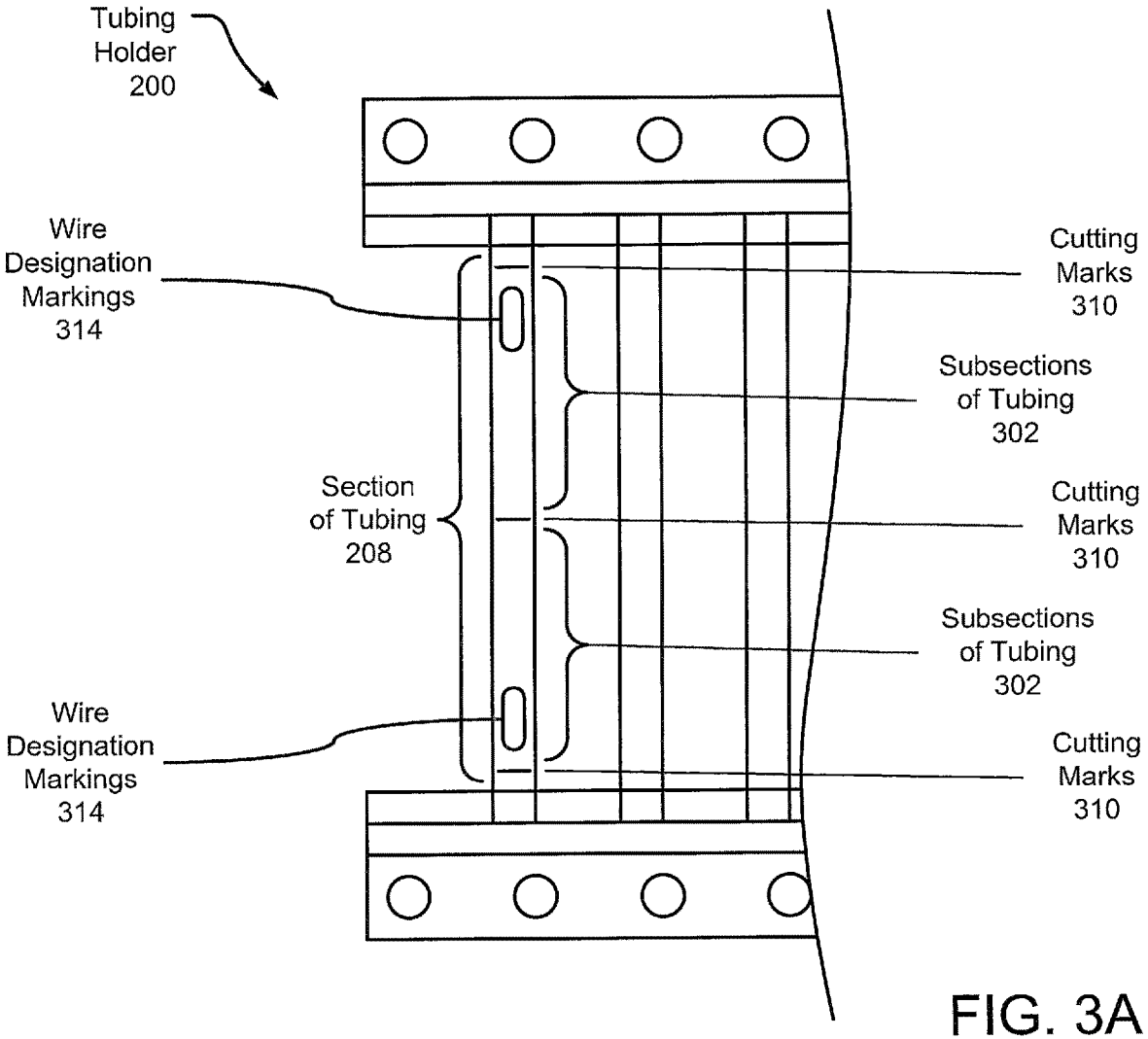
FIG. 3A is a diagram of a particular embodiment of the tubing holder of FIG. 2.
Figure 3B:
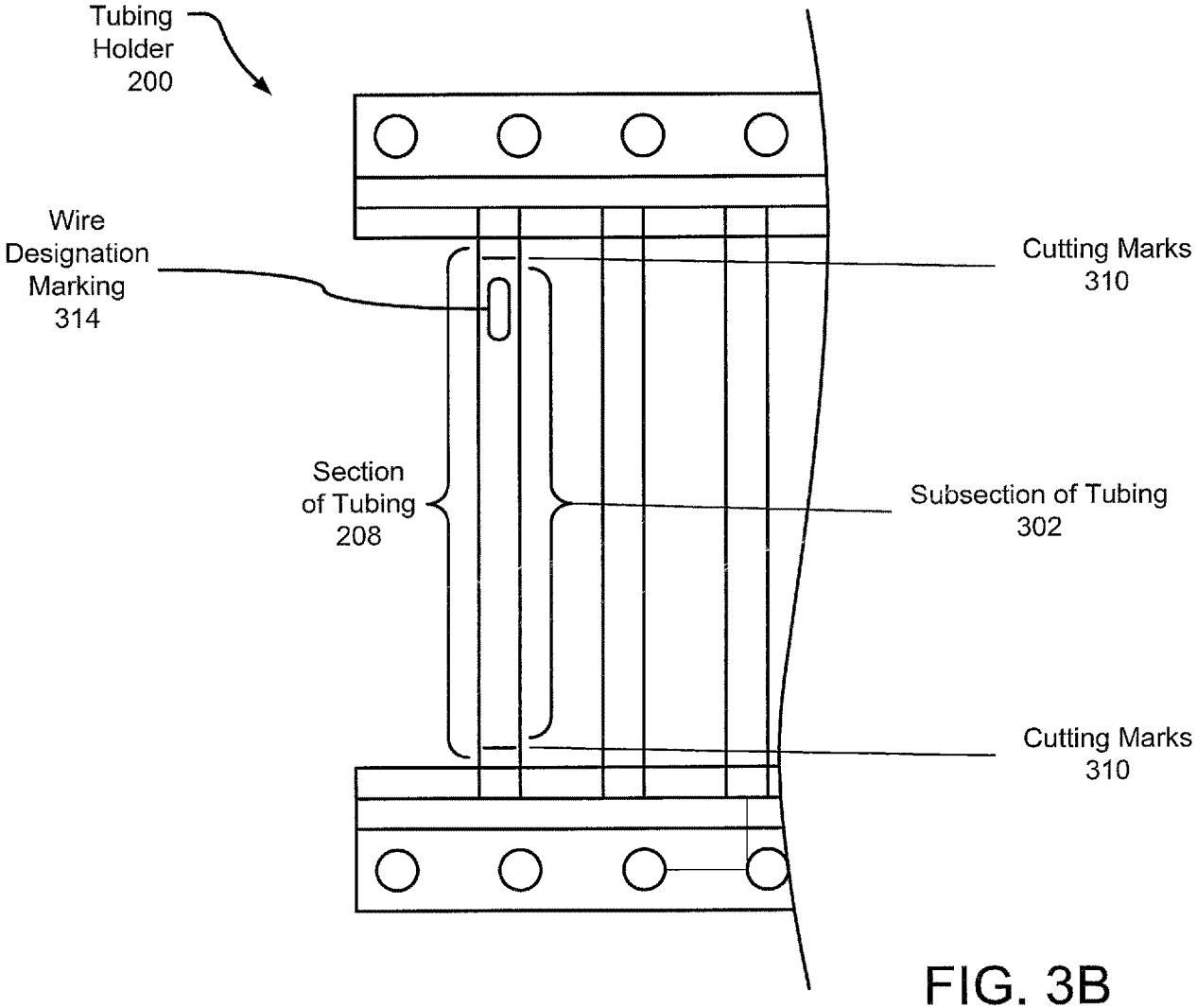
FIG. 3B is a diagram of another particular embodiment of the tubing holder of FIG. 2.
Figure 3C:
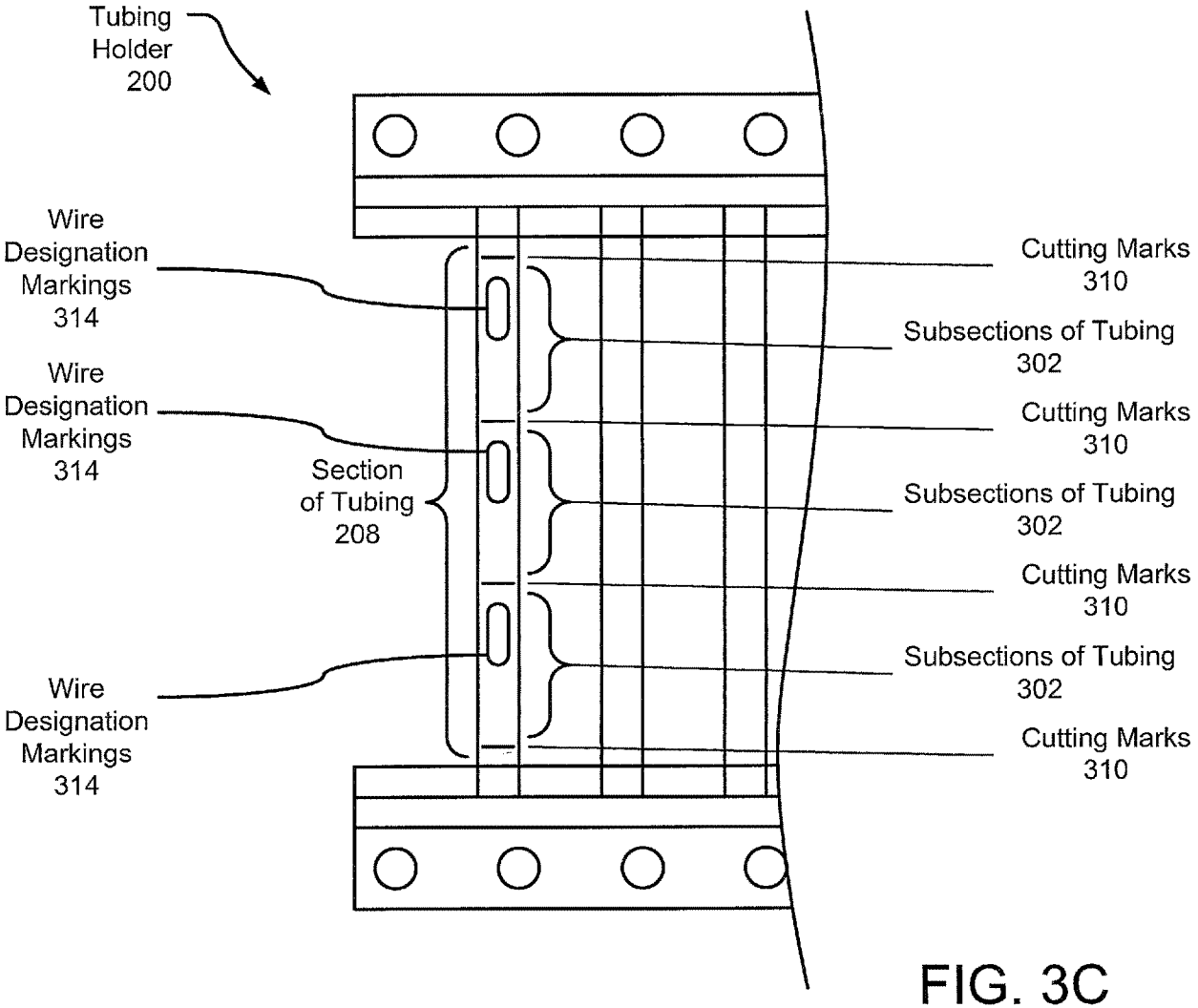
FIG. 3C is a diagram of another particular embodiment of the tubing holder of FIG. 2.

The section of tubing 208 extends away from the first spine 202 and from the second spine 212. For example, the section of tubing 208 is perpendicular to the first spine 202 and to the second spine 212 in a ladder arrangement. The section of tubing 208 includes a plurality of cutting marks 310 indicating locations where the section of tubing 208 may be cut into a plurality of subsections of tubing 302. As illustrated in the example of FIG. 3A, the section of tubing 208 includes three cutting marks 310 and may be cut into two subsections of tubing 302. As illustrated in the example of FIG. 3B, the section of tubing 208 includes two cutting marks 310 and may be cut into one subsection of tubing 302. As illustrated in the example of FIG. 3C, the section of tubing 208 includes four cutting marks 310 and may be cut into three subsections of tubing 302. Thus, FIGS. 3A-3C illustrate that the section of tubing 208 may include fewer or more than three cutting marks and may be cut into fewer or more than two subsections. Each subsection may correspond to a heat shrink tubing sleeve. The subsection(s) of tubing 302 may be dispensed (e.g., by the system 100 of FIG. 1) to an operator.

In a particular embodiment, the subsection(s) of tubing 302 may include wire designation markings 314. As illustrated in the example of FIG. 3A, the two subsections of tubing 302 include two wire designation markings 314. As illustrated in the example of FIG. 3B, the single subsection of tubing 302 may include one wire designation marking 314. As illustrated in the example of FIG. 3C, the three subsections of tubing 302 may include three wire designation markings 314. The wire designation markings 314 may include text, graphics, or both. The subsections of the same section of tubing may include the same wire designation markings 314. In this embodiment, the subsections of tubing 302 may be attached (e.g., by the operator) to each end of a particular wire. In a particular embodiment, a printer may print the wire designation markings 314 on the subsections prior to attachment of the sections of tubing to the tubing holder 200, subsequent to attachment of the sections to the tubing holder 200, or both.

Figure 2:
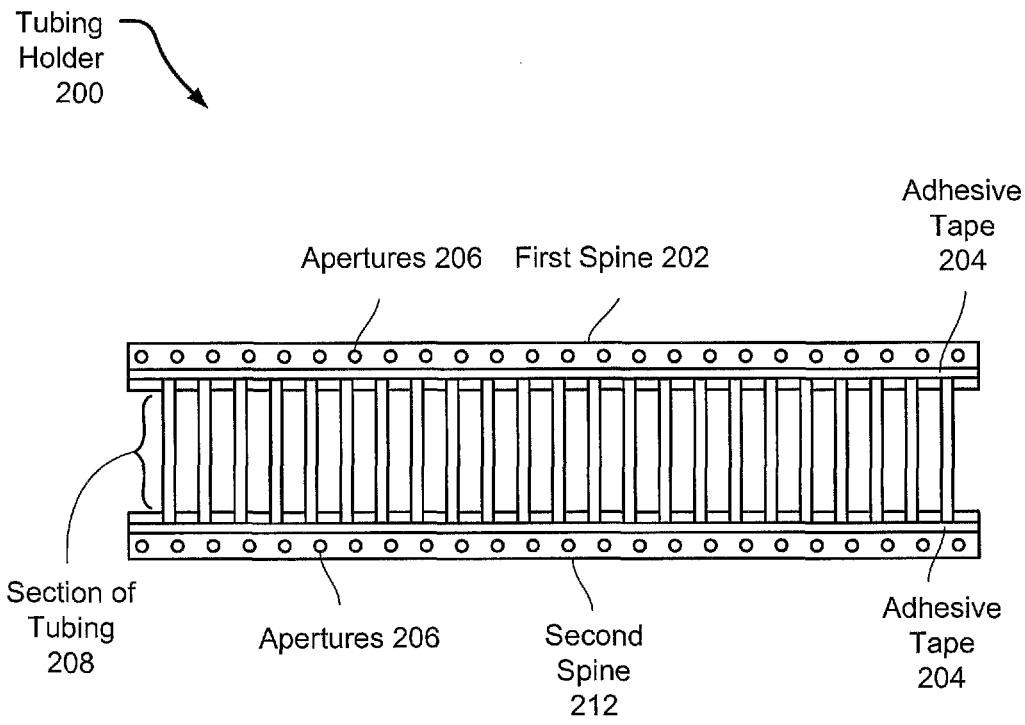
FIG. 2 is a diagram of a particular embodiment of a tubing holder that may be processed by the system of FIG. 1.

As illustrated in FIG. 2, a plurality of apertures 206 are spaced equidistantly along the first spine 202 and along the second spine 212. In a particular embodiment, the plurality of apertures 206 may be differently located, spaced, or both. In a particular embodiment, a spine (e.g., the first spine 202, the second spine 212, or both) may include fewer (e.g., none or one) than a plurality of apertures.

During operation, a feed system (e.g., the feeder module 102 of FIG. 1) may engage the tubing holder 200 using the apertures 206 to feed the tubing holder 200 to a cutting system (e.g., the cutter module 104 of FIG. 1). When a section of tubing (e.g., the section of tubing 208) reaches the cutting system, the cutting system may cut the section of tubing 208 at the locations identified by the cutting marks 310 (e.g., three cutting marks 310 in FIG. 3A, two cutting marks 310 in FIG. 3B, or four cutting marks in FIG. 3C) to separate the subsection(s) of tubing 302 from the tubing holder 200. A feed direction of the feed system (e.g., the feeder module 102 of FIG. 1) may be controlled by a toggle switch. When the toggle switch is activated, the feed direction of the feed system (e.g., the feeder module 102 of FIG. 1) may be reversed to remove the tubing holder 200.

Figure 4:
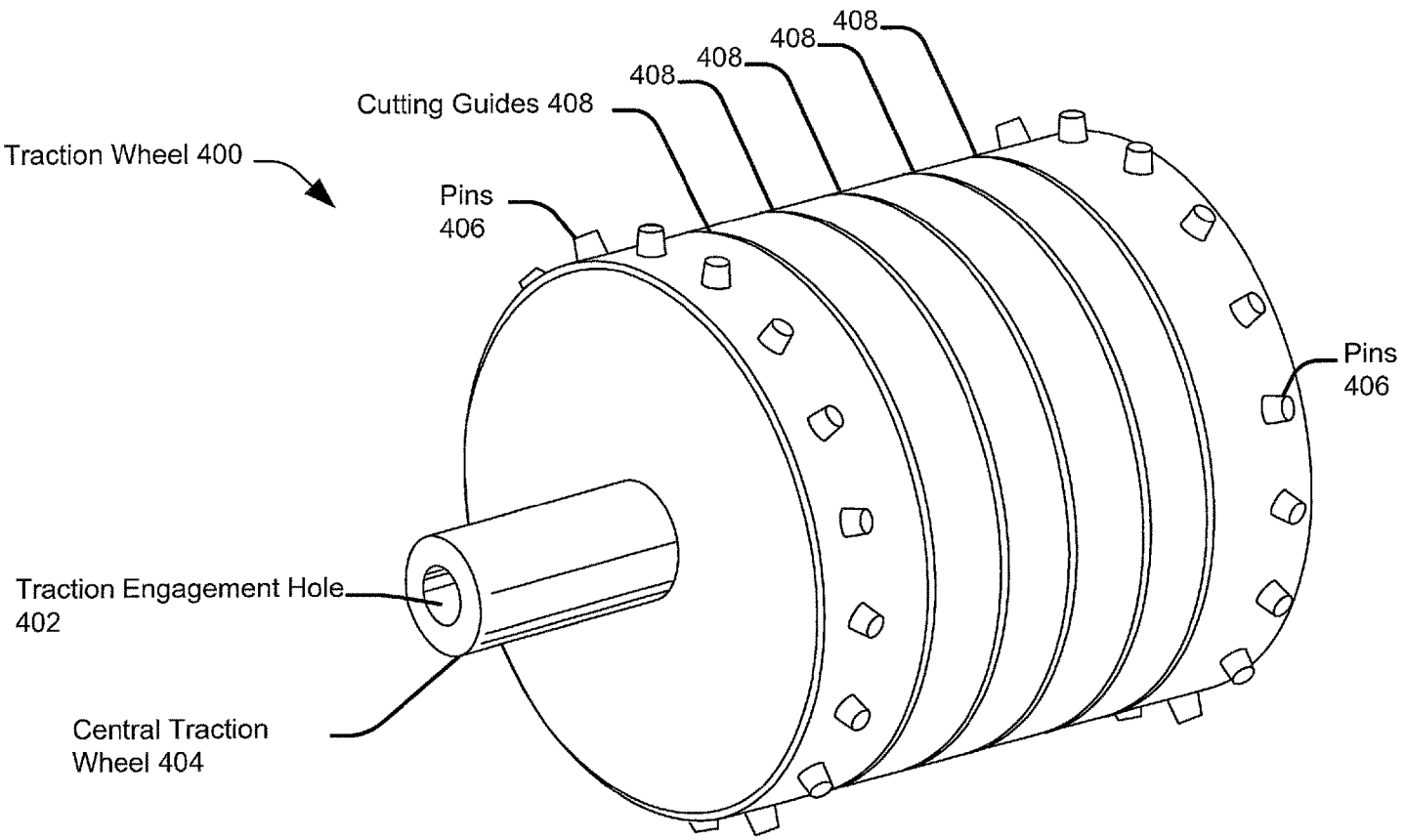
FIG. 4 is a diagram of a particular embodiment of a traction wheel of the system of FIG. 1.

Referring to FIG. 4, a diagram of a particular embodiment of a traction wheel is shown and is generally designated 400. The traction wheel 400 may be included in the feeder module 102 of FIG. 1. The traction wheel 400 includes a central traction wheel 404 (or axle) with a traction engagement hole 402. A plurality of pins 406 project radially outward from the central traction wheel 404. In a particular embodiment, the traction wheel 400 may include fewer (e.g., one or none) than a plurality of pins. The pins 406 may be configured (e.g., sized, shaped, or both) to engage a tubing holder (e.g., the tubing holder 200). To illustrate, one or more of the pins 406 may be configured to engage one or more of the apertures 206 of FIG. 2. The central traction wheel 404 includes a plurality of cutting guides 408. As illustrated, the central traction wheel 404 includes five cutting guides 408. In a particular embodiment, the central traction wheel 404 may include fewer or more than five cutting guides. Each of the cutting guides 408 may provide a track on the traction wheel 400 for a particular cutting blade of a cutting system. For example, three of the cutting guides 408 may provide three tracks on the traction wheel 400 for three cutting blades of a first cutting wheel assembly (see FIG. 6A) that includes three cutting blades (e.g., for cutting the section of tubing 208 into two subsections of tubing 302 in FIG. 3A). As another example, two of the cutting guides 408 may provide two tracks on the traction wheel 400 for two cutting blades of a second cutting wheel assembly (see FIG. 6B) that includes two cutting blades (e.g., for cutting the section of tubing 208 into one subsection of tubing 302 in FIG. 3B). As a further example, four of the cutting guides 408 may provide four tracks on the traction wheel 400 for four cutting blades of a third cutting wheel assembly (see FIG. 6C) that includes four cutting blades (e.g., for cutting the section of tubing 208 into three subsections of tubing 302 in FIG. 3C).

During operation, the traction wheel 400 may advance a tubing holder (e.g., the tubing holder 200 of FIG. 2) toward a cutting system (e.g., the cutter module 104 of FIG. 1). For example, one or more of the pins 406 may engage one or more of the apertures 206 of FIG. 2. The traction wheel 400 may be rotatable about the traction engagement hole 402 (see FIG. 8B). As the traction wheel 400 is rotated, the one or more of the pins 406 may engage the one or more of the apertures 206 and may pull the tubing holder 200 in the direction of rotation of the traction wheel 400 towards the cutting system. When rotated in a first (e.g., forward) direction, the traction wheel 400 may advance the tubing holder 200 towards the cutting system. When rotated in a second (e.g., reverse) direction, the traction wheel 400 may move the tubing holder 200 away from the cutting system. In a particular embodiment, the traction wheel 400 may be rotated using an electric motor (e.g., the first motor 702 of FIG. 7) that engages the traction engagement hole 402. In a particular embodiment, the traction wheel 400 may be driven by, for example, a non-electric motor, a hand crank, etc. In a particular embodiment, the traction wheel 400 may use vacuum pressure or may rely on frictional forces to engage the tubing holder 200. In a particular embodiment, the feed system (e.g., the feeder module 102 of FIG. 1) may utilize a different manner of engaging the tubing holder 200 rather than using the traction wheel 400, such as a chute system, a belt system, a moving clamp, etc.

Thus, the traction wheel 400 may feed the tubing holder 200 to the cutting system (e.g., the cutter module 104 of FIG. 1). Automated feeding of the tubing holder 200 may increase efficiency and reduce cost of separating the tubing sleeves from the tubing holder 200.

Figure 5A:
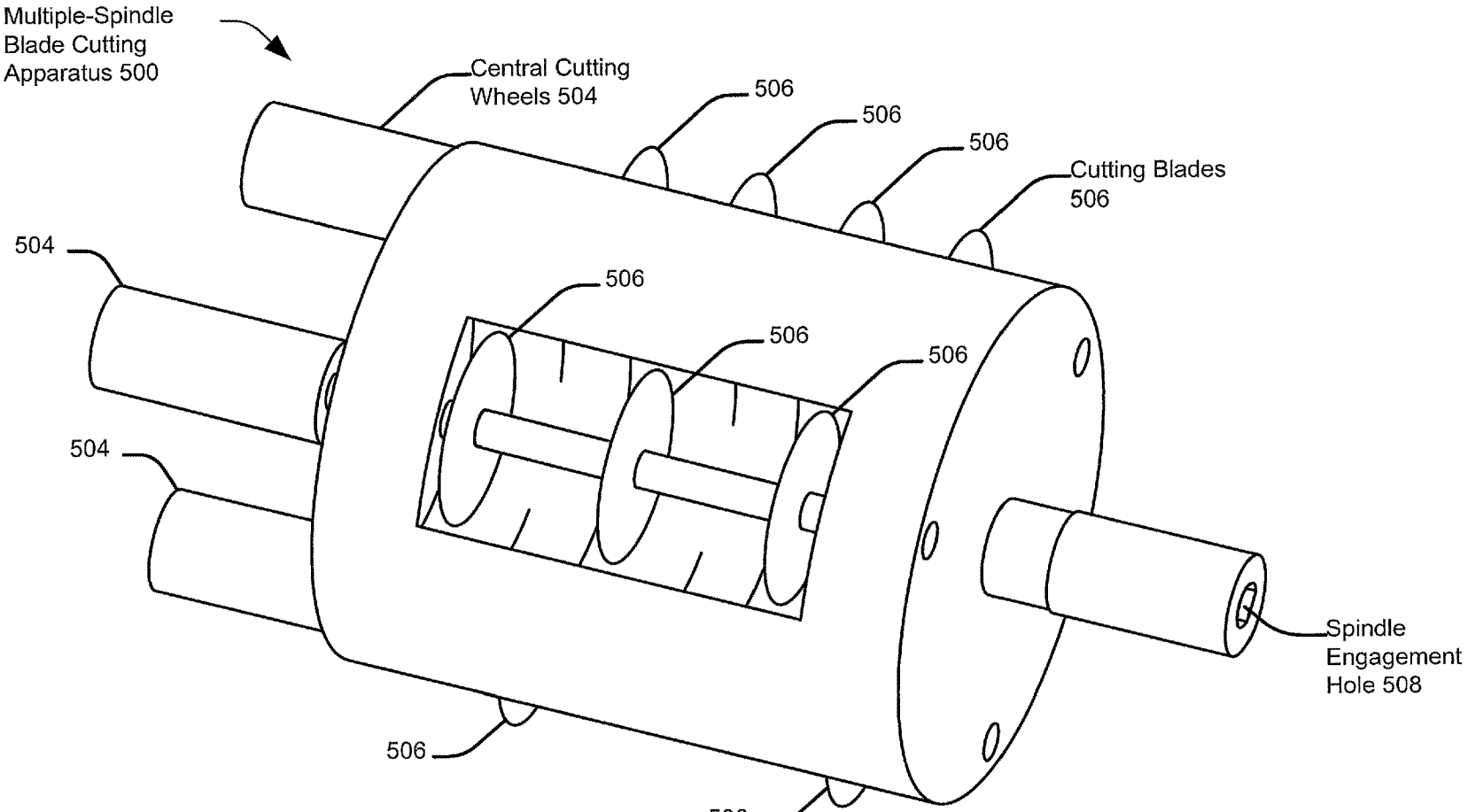
FIGS. 5A and 5B are perspective views of a particular embodiment of a cutting system that includes a plurality of cutting wheel assemblies with different numbers of cutting blades.
Figure 5B:
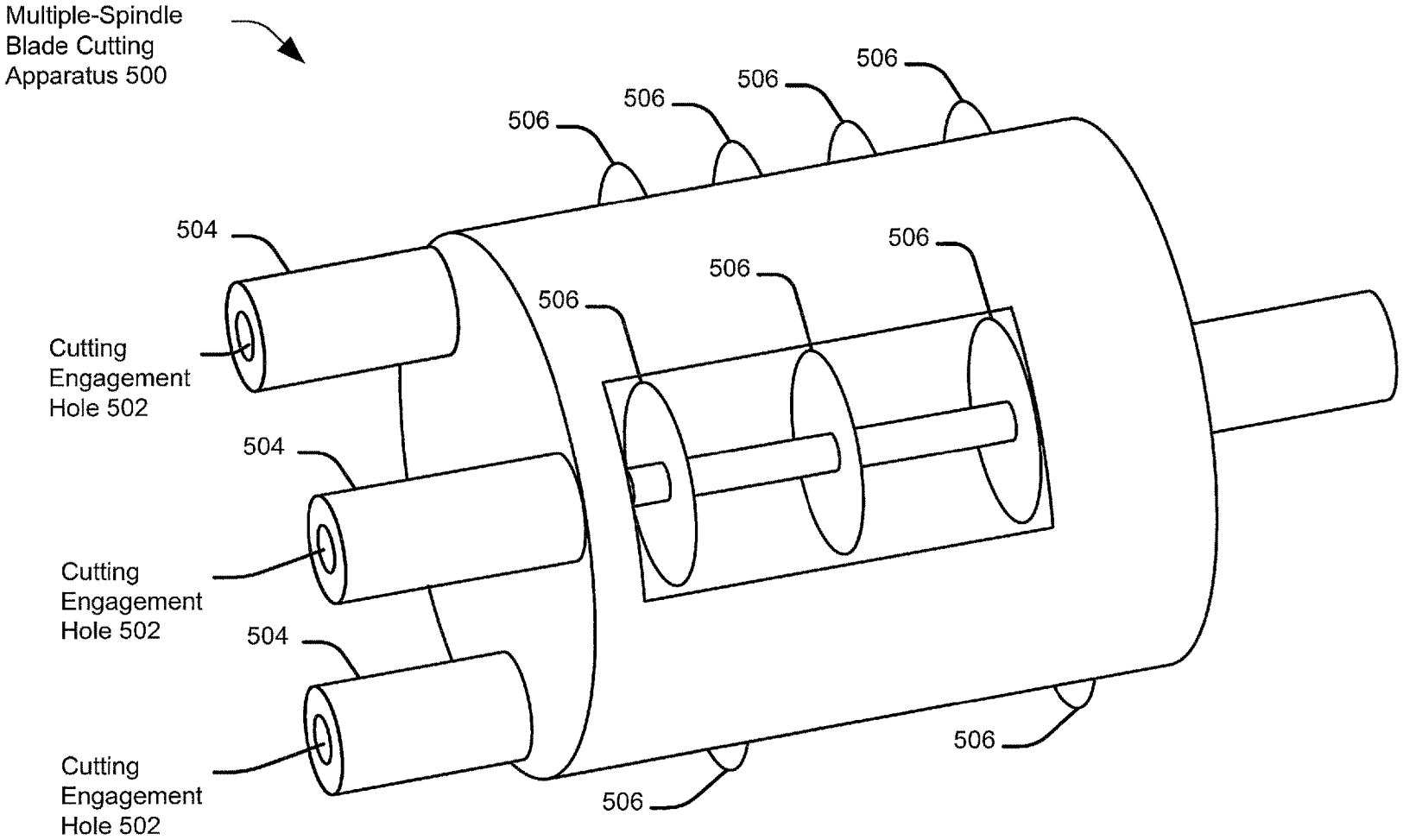

Referring to FIGS. 5A and 5B, a particular embodiment of a multiple-spindle blade cutting apparatus is illustrated and generally designated 500. FIG. 5A is a perspective view from one end of the multiple-spindle blade cutting apparatus 500, and FIG. 5B is a perspective view from another end of the multiple-spindle blade cutting apparatus 500. The multiple-spindle blade cutting apparatus 500 includes multiple blade cutting assemblies with different numbers of cutting blades, as described further herein with respect to FIGS. 6A-6C.

The multiple-spindle blade cutting apparatus 500 of FIGS. 5A and 5B includes multiple central cutting wheels 504 (or axles) with multiple cutting engagement holes 502 (see FIG. 5B). A plurality of cutting blades 506 extend radially outward from each of the central cutting wheels 504. As described further herein with respect to FIGS. 6A-6C, each of the central cutting wheels 504 may be associated with different cutting wheel assemblies that include different numbers of cutting blades. A spindle engagement hole 508 may be used to select a particular cutting wheel assembly of multiple cutting wheel assemblies (see FIG. 8B). As illustrated and described herein with respect to FIG. 6A, the multiple-spindle blade cutting apparatus 500 includes a first cutting wheel assembly 510 that includes three cutting blades. The multiple-spindle blade cutting apparatus 500 also includes a second cutting wheel assembly 512 that includes two cutting blades, as illustrated and described herein with respect to FIG. 6B. The multiple-spindle blade cutting apparatus 500 further includes a third cutting wheel assembly 514 that includes three cutting blades, as illustrated and described herein with respect to FIG. 6C. In other embodiments, the multiple-spindle blade cutting apparatus 500 may include different numbers of central cutting wheels 504 and/or different numbers of cutting blades 506 on the central cutting wheels 504. Further, in other embodiments, two or more central cutting wheels 504 may have the same number of cutting blades 506 with different spacings.

Figure 6A:
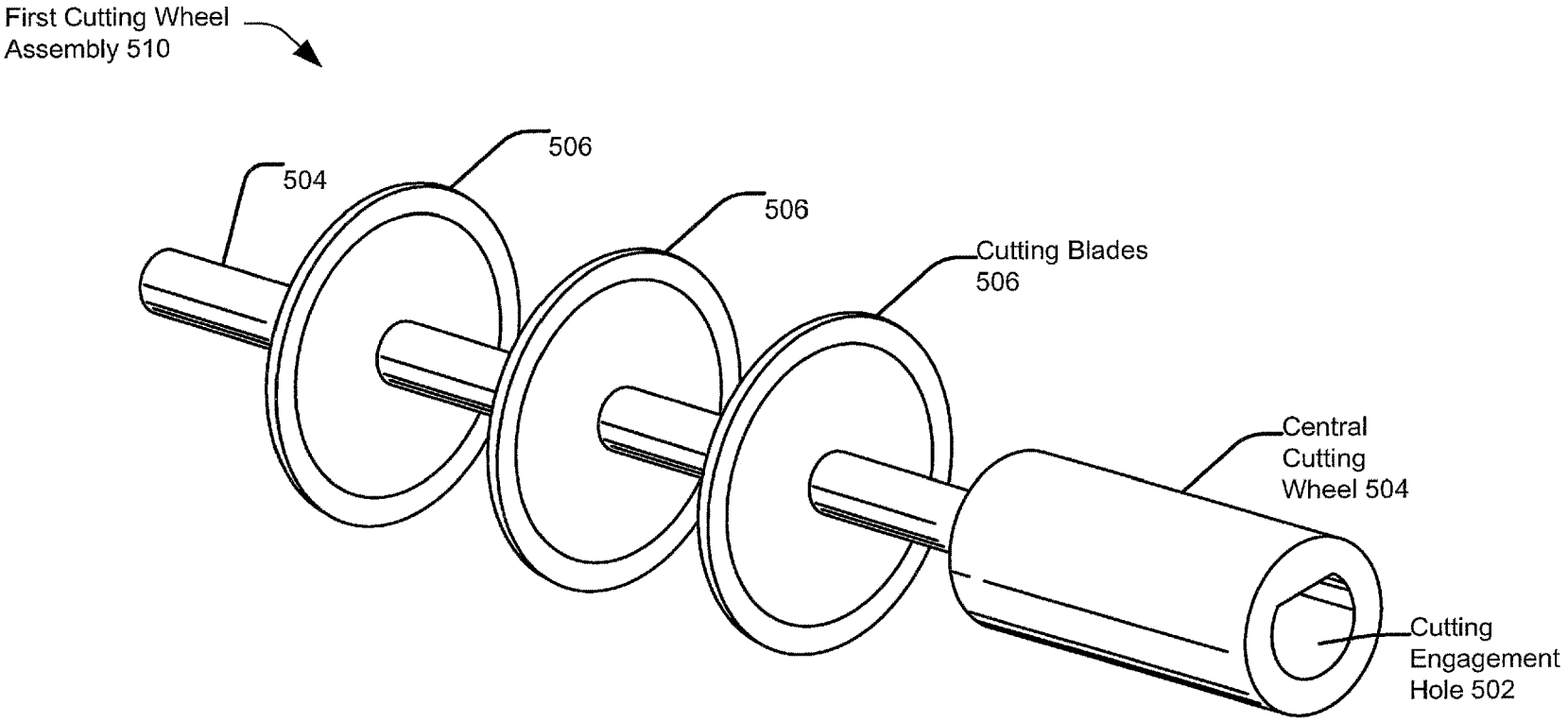
FIG. 6A is a diagram of a particular embodiment of a first example cutting wheel assembly of that includes a first number of cutting blades.
Figure 6B:
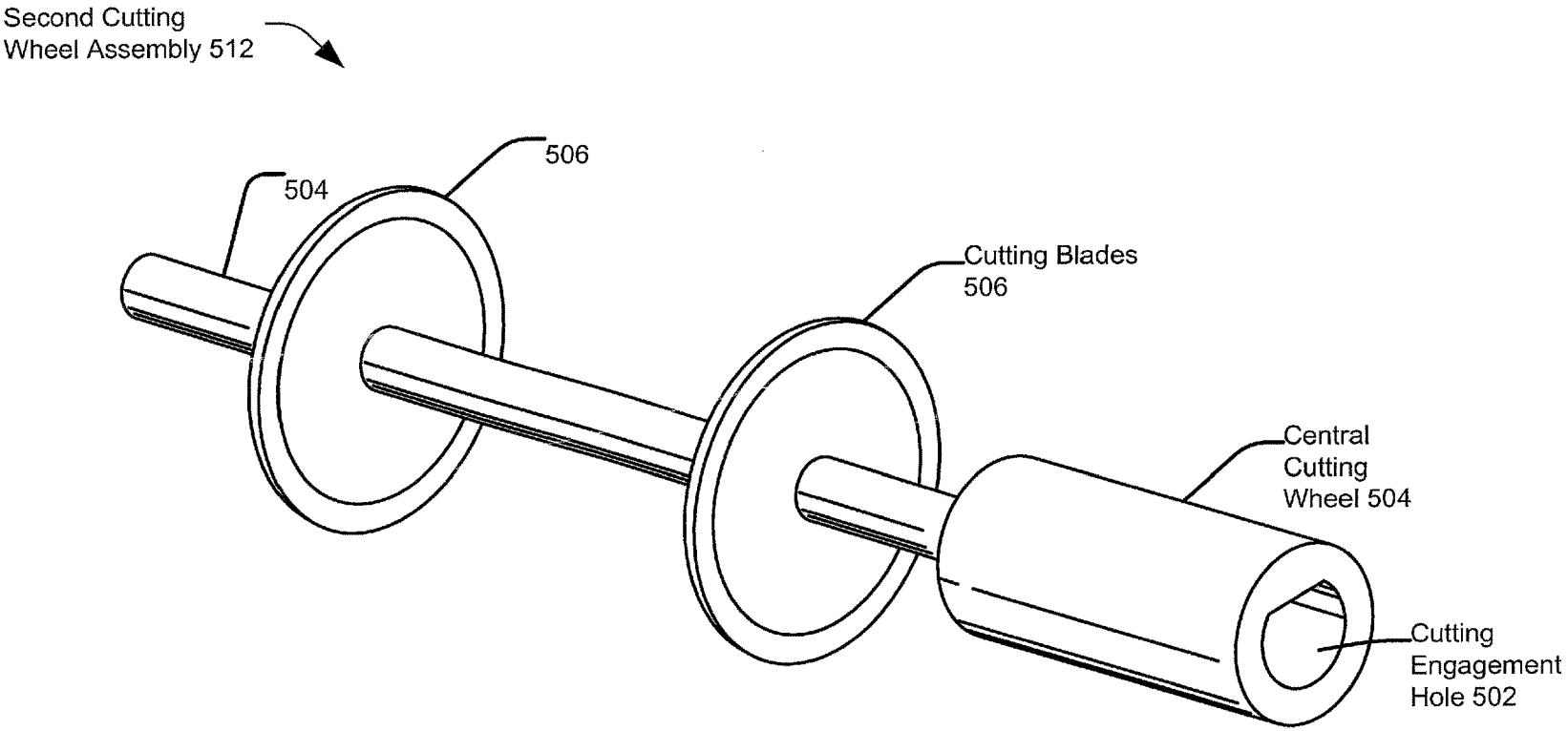
FIG. 6B is a diagram of a particular embodiment of a second example cutting wheel assembly that includes a second number of cutting blades.
Figure 6C:
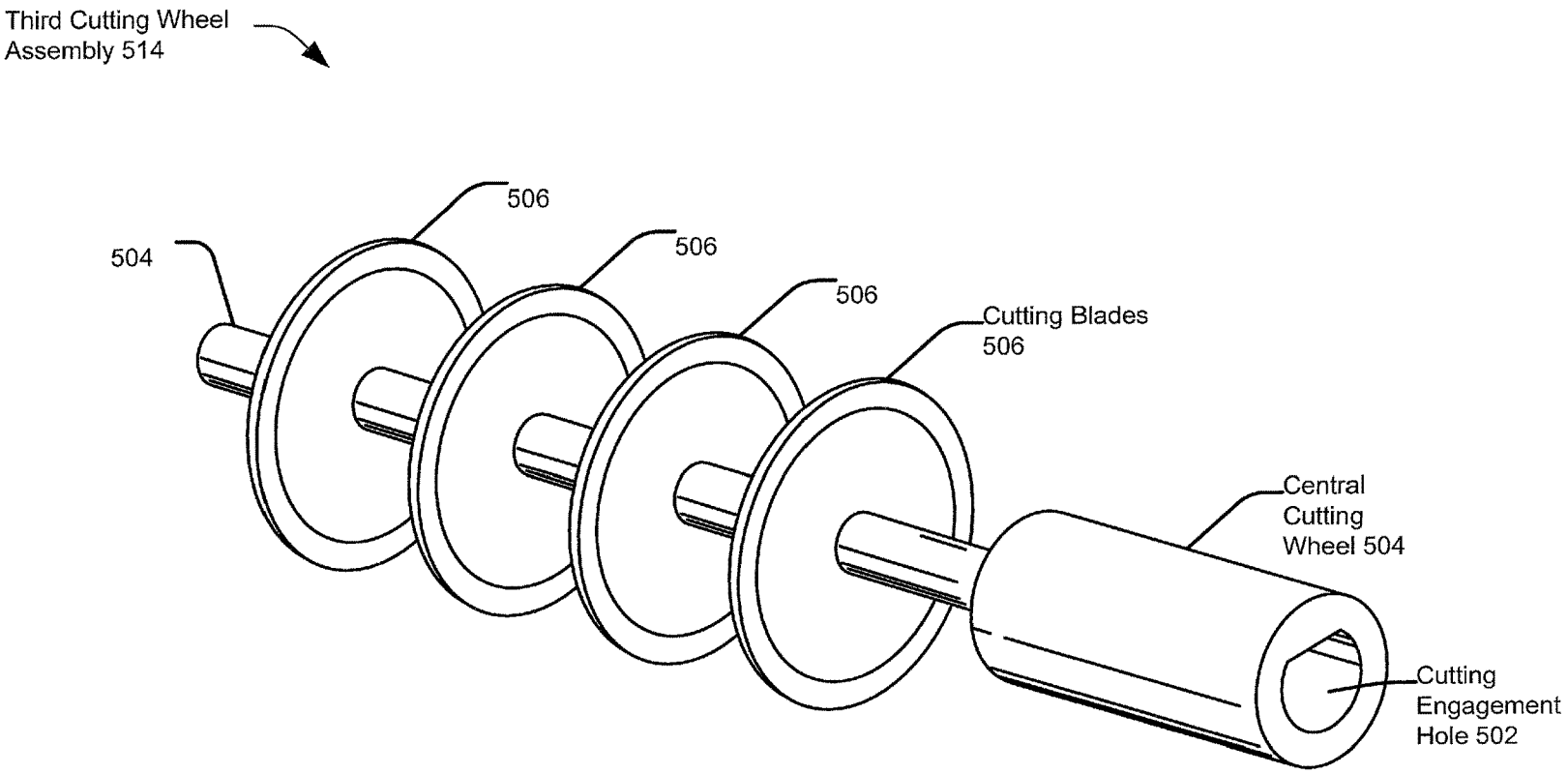
FIG. 6C is a diagram of a particular embodiment of a third example cutting wheel assembly that includes a third number of cutting blades.

Referring to FIG. 6A, a diagram of a particular embodiment of a first cutting wheel assembly 510 is shown. The first cutting wheel assembly 510 includes a central cutting wheel 504 (or axle) with a cutting engagement hole 502. A plurality of cutting blades 506 extend radially outward from the central cutting wheel 504. As illustrated in FIG. 6A, the first cutting wheel assembly 510 includes three cutting blades 506. Referring to FIG. 6B, a diagram of a particular embodiment of a second cutting wheel assembly 512 (that includes two cutting blades 506) is shown. Referring to FIG. 6C, a diagram of a particular embodiment of a third cutting wheel assembly 514 (that includes four cutting blades 506) is shown.

During operation, a particular cutting wheel assembly (e.g., the first cutting wheel assembly 510, the second cutting wheel assembly 512, or the third cutting wheel assembly 514) may cut tubing sleeves from a tubing holder (e.g., the tubing holder 200) as a feed system (e.g., the feeder module 102 of FIG. 1 or the traction wheel 400 of FIG. 4) advances the tubing holder 200 toward the particular cutting wheel assembly 510, 512, or 514. The cutting wheel assemblies 510, 512, and 514 may be rotatable. As the particular cutting wheel assembly rotates, the cutting blades 506 may cut a section of tubing (e.g., the section of tubing 208) as the section of tubing 208 passes through the cutting blades 506. The cutting force may separate one or more subsections of the section of tubing 208 from the tubing holder 200. For example, the cutting force of the three cutting blades 506 of the first cutting wheel assembly 510 (see FIG. 6A) may cut the section of tubing 208 at three locations indicated by the cutting marks 310 (see FIG. 3A), separating two subsections of tubing 302 from the tubing holder 200. As another example, the cutting force of the two cutting blades 506 of the second cutting wheel assembly 512 (see FIG. 6B) may cut the section of tubing 208 at two locations indicated by the cutting marks 310 (see FIG. 3B), separating one subsection of tubing 302 from the tubing holder 200. As a further example, the cutting force of the four cutting blades 506 of the third cutting wheel assembly 514 (see FIG. 6C) may cut the section of tubing 208 at four locations indicated by the cutting marks (see FIG. 3C), separating three subsections of tubing 302 from the tubing holder 200.

In a particular embodiment, an electric motor (e.g., the second motor 706 of FIG. 7) may rotate the particular cutting wheel assembly by engaging a particular cutting engagement hole 502 that is associated with the particular cutting wheel assembly. In a particular embodiment, the particular cutting wheel assembly may be driven by, for example, a non-electric motor, a hand crank, etc. In a particular embodiment, an electric motor (e.g., the third motor 709 of FIG. 7) may rotate the multiple-spindle blade cutting apparatus 500 to select a particular cutting wheel assembly by engaging the spindle engagement hole 508 (see FIG. 5A and FIG. 8B). Alternatively, a particular cutting wheel assembly may be engaged/selected using a non-electric motor, a hand crank, etc. to rotate the multiple-spindle blade cutting apparatus 500 in order to select a particular cutting wheel assembly with a particular number of cutting blades (e.g., two, three, or four cutting blades).

In a particular embodiment, the cutting system (e.g., the cutter module 104 of FIG. 1) may utilize a different manner of cutting the section of tubing 208 rather than using the particular cutting wheel assembly. For example, the cutting system may utilize a continuous stream or blast of compressed air to cut the section of tubing 208. As another example, the cutting system may utilize a laser system or a wire system to cut the section of tubing 208. As another example, the cutting system may utilize a wedge-shaped cutter to cut the section of tubing 208.

Thus, the particular cutting wheel assembly may receive a section of tubing (e.g., the section of tubing 208) of the tubing holder 200 fed by the traction wheel 400 and may cut the section of tubing 208 at a plurality of locations to separate the subsections of tubing 302 from the tubing holder 200. For example, the first cutting wheel assembly 510 (see FIG. 6A) may cut the section of tubing 208 at three locations to separate two subsections of tubing 302 from the tubing holder 200. As another example, the second cutting wheel assembly 512 (see FIG. 6B) may cut the section of tubing 208 at two locations to separate one subsection of tubing 302 from the tubing holder 200. As a further example, the third cutting wheel assembly 514 (see FIG. 6C) may cut the section of tubing 208 at four locations to separate three subsections of tubing 302 from the tubing holder 200. Automated cutting of the section of tubing 208 may increase efficiency and reduce cost of separating the tubing sleeves from the tubing holder 200.

Figure 7:
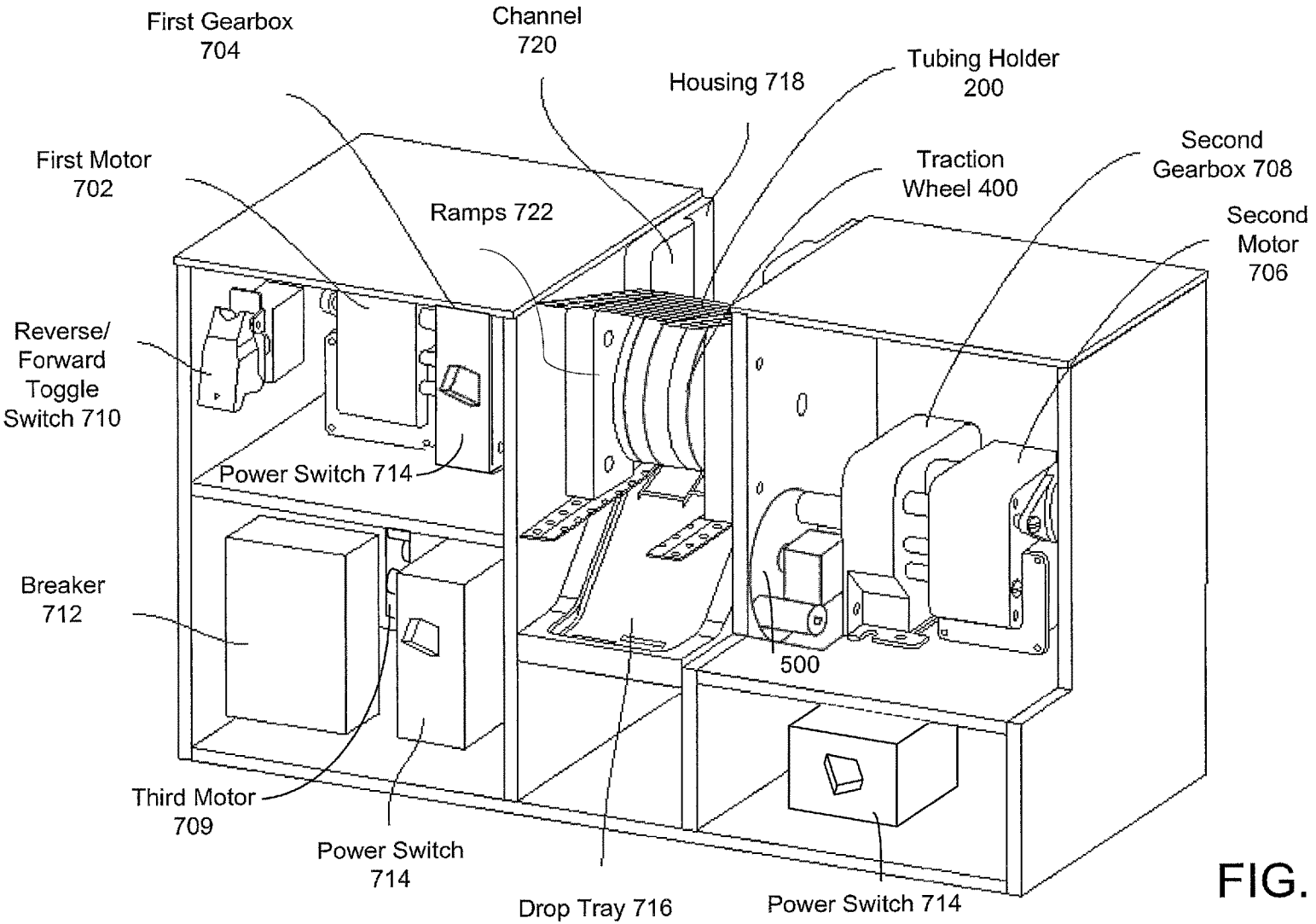
FIG. 7 is a perspective view of an apparatus that may be included in the system of FIG. 1.

FIG. 7 illustrates a particular embodiment of an apparatus generally designated 700. The apparatus 700 may include, may be included in, or may correspond to the system 100 of FIG. 1. The apparatus 700 is illustrated in FIG. 7 with a removed cover. The apparatus 700 includes the traction wheel 400 of FIG. 4 coupled to a first motor 702 and a first gearbox 704. A housing 718 and the traction wheel 400 cooperatively define a channel 720 through which a tubing holder (e.g., the tubing holder 200 of FIG. 2) may travel when propelled by the traction wheel 400. The apparatus 700 includes the multi-spindle blade cutting apparatus 500 having a plurality of cutting wheel assemblies. The apparatus 700 includes a third motor 709 and a third gearbox (obscured from view in FIG. 7). The spindle engagement hole 508 (see FIG. 5A and FIG. 8B) may be engaged, and the third motor 709 may rotate the multi-spindle blade cutting apparatus 500 such that a particular cutting wheel assembly is coupled to a second motor 706 and a second gearbox 708 (via a particular cutting engagement hole 502, as shown in FIG. 5B). The apparatus 700 may include a drop tray 716. The apparatus 700 may include a reverse/forward toggle switch 710 that may control a direction of rotation of the traction wheel 400. The apparatus 700 may include a breaker 712 and one or more power switches 714 (e.g., a first power switch associated with the first motor 702, a second power switch associated with the second motor 706, and a third power switch associated with the third motor 709).

During operation, a tubing holder (e.g., the tubing holder 200 of FIG. 2) may be positioned in the channel 720 (e.g., by an operator) such that the traction wheel 400 engages the tubing holder 200. For example, ramps 722 may be utilized (e.g., by the operator) to position the tubing holder 200 in the channel 720. One or more of the projecting pins 406 of FIG. 4 may engage one or more of the apertures 206 of FIG. 2. A first position (e.g., up) of the reverse/forward toggle switch 710 may indicate a first direction (e.g., forward) of rotation of the traction wheel 400. When the power switch 714 associated with the first motor 702 is activated (e.g., is in an "on" position), the traction wheel 400 and the particular cutting wheel assembly that is coupled to the second motor 706 via the particular cutting engagement hole 502 and the second gearbox 708 may begin rotating. One or more cutting blades 506 may be in contact with the traction wheel 400 as the cutting blades 506 (e.g., three cutting blades 506 in the case of the first cutting wheel assembly 510 of FIG. 6A, two cutting blades 506 in the case of the second cutting wheel assembly 512 of FIG. 6B, or four cutting blades 506 in the case of the third cutting wheel assembly 514 of FIG. 6C) and the traction wheel 400 rotate. For example, the cutting blades 506 may be in contact with the traction wheel 400 at a portion of the cutting guides 408. As the traction wheel 400 rotates in the first direction, the one or more of the projecting pins 406 engaging the one or more of the apertures 206 may advance the tubing holder 200 towards the particular cutting wheel assembly. When a section of tubing (e.g., the section of tubing 208 of FIG. 2) reaches the particular cutting wheel assembly, the cutting blades 506 may cut the section of tubing 208 at a plurality of locations (e.g., the plurality of locations indicated by the cutting marks 310 of FIGS. 3A-3C) to separate one or more subsections of tubing from the tubing holder 200. To illustrate, when the first cutting wheel assembly 510 (see FIG. 6A) is selected, the three cutting blades 506 may cut the section of tubing 208 at three locations (e.g., the three locations indicated by the cutting marks 310 of FIG. 3A). When the second cutting wheel assembly 512 (see FIG. 6B) is selected, the two cutting blades 506 may cut the section of tubing 208 at two locations (e.g., the two locations indicated by the cutting marks 310 of FIG. 3B). When the third cutting wheel assembly 514 (see FIG. 6C) is selected, the four cutting blades 506 may cut the section of tubing 208 at four locations (e.g., the four locations indicated by the cutting marks 310 of FIG. 3C). In the case of multiple subsections of tubing being cut, the apparatus 700 may dispense the subsections of tubing 302 substantially simultaneously with one another in the drop tray 716.

A second position of the reverse/forward toggle switch 710 may indicate a second direction (e.g., reverse) of rotation of the traction wheel 400. As the traction wheel 400 rotates in the second direction, the tubing holder 200 may move away from the particular cutting wheel assembly and may be removed (e.g., by the operator). When the power switch 714 associated with the first motor 702 is deactivated (e.g., is in an "off" position), the traction wheel 400 and the particular cutting wheel assembly may stop rotating.

In a particular embodiment, the first motor 702 may drive rotation of the traction wheel 400 via the first gearbox 704. The first gearbox 704 may control a speed of rotation of the traction wheel 400. In another embodiment, the traction wheel 400 may be driven directly by the first motor 702. The speed of rotation of the traction wheel 400 may control a speed of processing the tubing holder 200 through the apparatus 700 (e.g., the speed of cutting tubing sleeves from the tubing holder 200). In a particular embodiment, a speed of the first motor 702, and thus the speed of rotation of the traction wheel 400, may be variably controlled by an operator. In another particular embodiment, the speed of rotation of the traction wheel 400 may be fixed.

In a particular embodiment, the second motor 706 may drive rotation of the particular cutting wheel assembly via the second gearbox 708. The second gearbox 708 may control a speed of rotation of the particular cutting wheel assembly. In another embodiment, the particular cutting wheel assembly may be driven directly by the second motor 706. The speed of rotation of the particular cutting wheel assembly may control a speed of processing the tubing holder 200 through the apparatus 700 (e.g., the speed of cutting tubing sleeves from the tubing holder 200). In a particular embodiment, a speed of the second motor 706, and thus the speed of rotation of the particular cutting wheel assembly, may be variably controlled by an operator. In a particular embodiment, the speed of rotation of the particular cutting wheel assembly may be fixed. Different diameters of the cutting blades 506 (see FIGS. 5A-5B and 6A-6C) may be used to change the speed of processing the tubing holder 200.

Thus, the apparatus 700 may cut a section of tubing of the tubing holder 200 in turn as the tubing holder 200 advances through the apparatus 700. A speed of processing the tubing holder 200 may be controlled by an operator. The automatic separation of the tubing sleeves from the tubing holder 200 may improve efficiency and reduce cost associated with using the tubing sleeves.

Figure 8A:
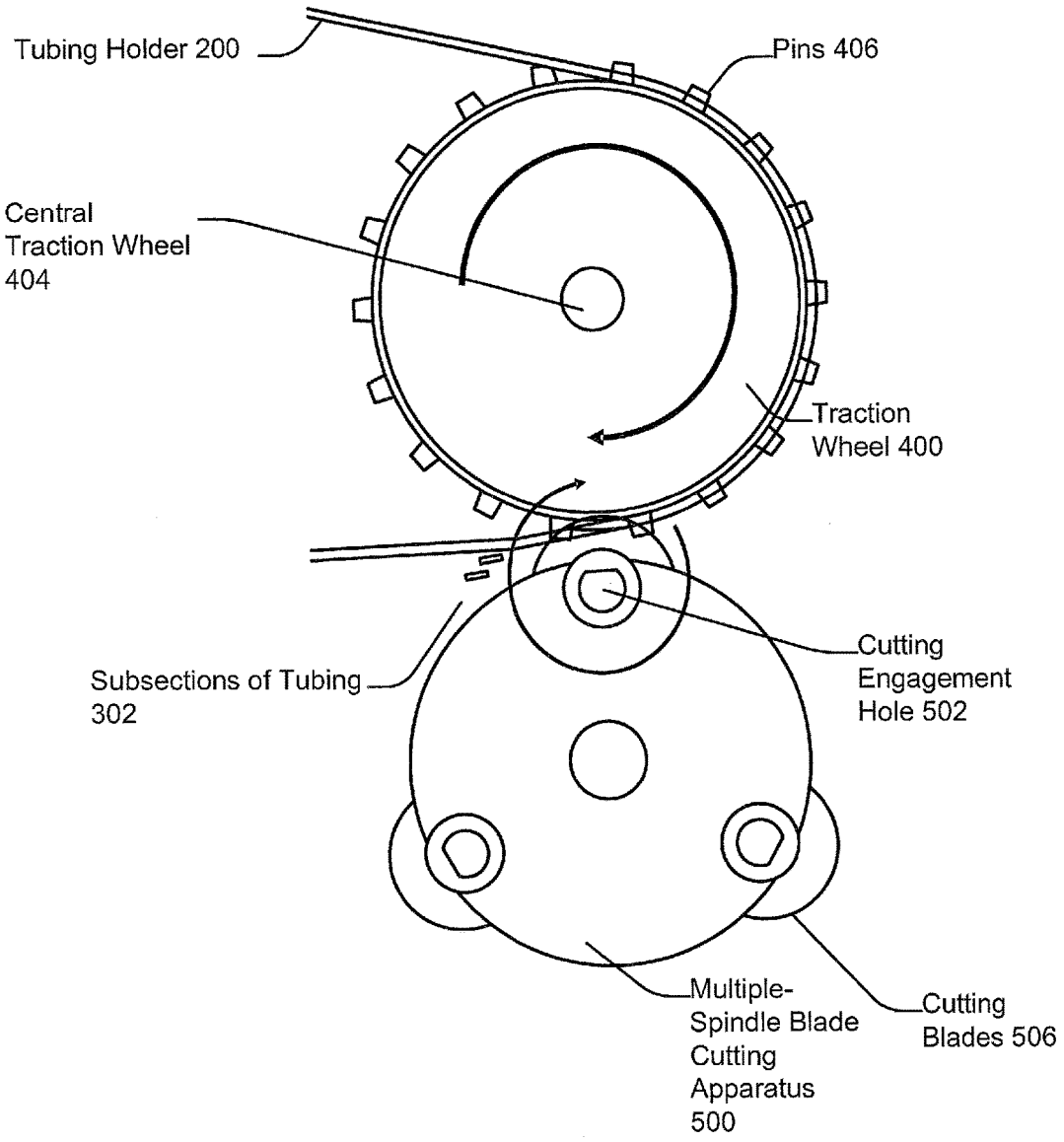
FIGS. 8A and 8B are sectional views of a portion of the apparatus of FIG. 7.
Figure 8B:
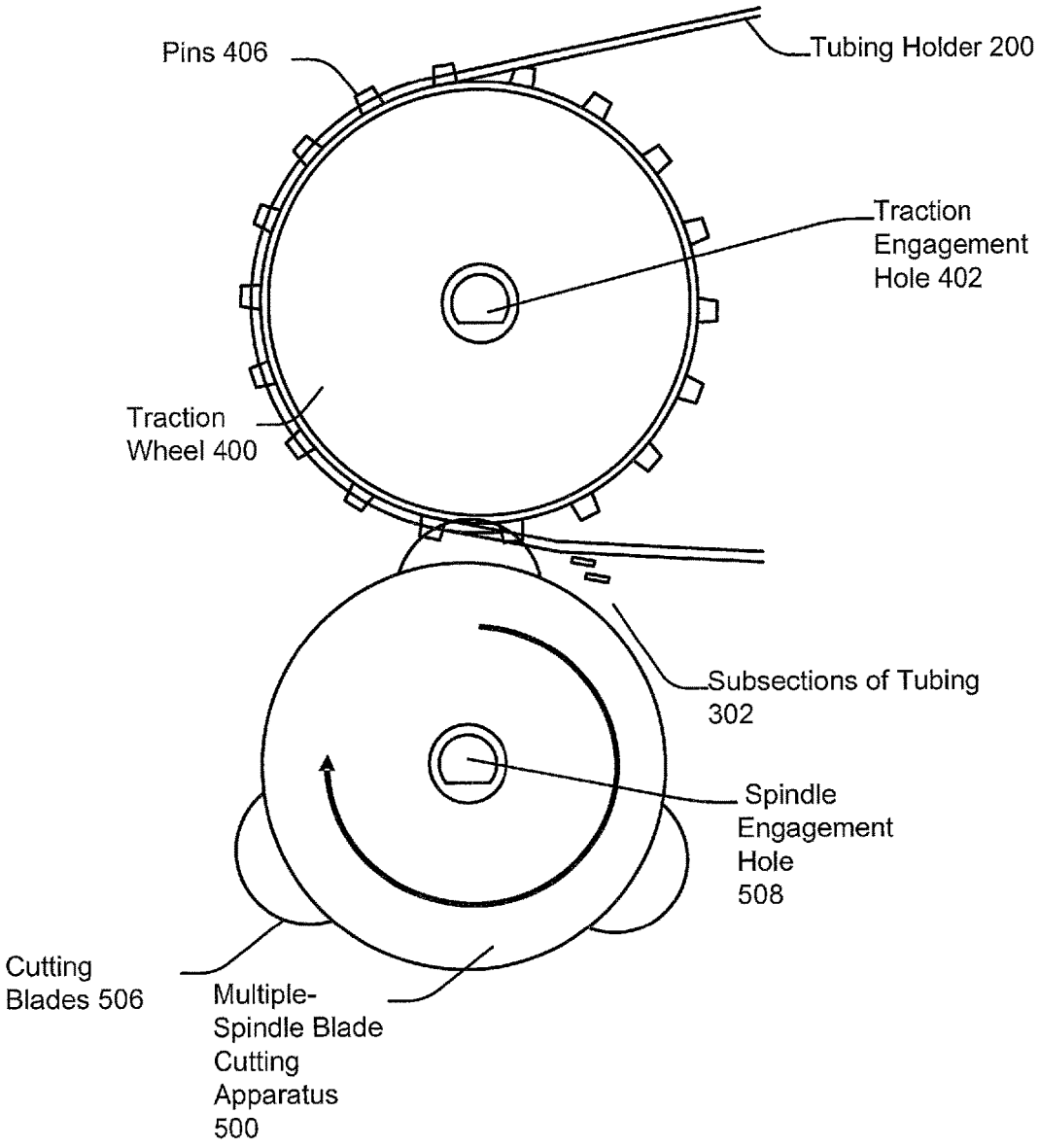

Referring to FIGS. 8A and 8B, sectional views of the apparatus 700 of FIG. 7 are shown. During operation, the traction wheel 400 may rotate in a first direction (e.g., clock-wise in the sectional view shown in FIG. 8A), and the particular cutting wheel assembly may rotate in the same direction or an opposite direction (e.g., anti-clockwise). As the traction wheel 400 rotates and advances a tubing holder (e.g., the tubing holder 200 of FIG. 2) towards the particular cutting wheel assembly, the cutting blades 506 may cut a section of tubing (e.g., the section of tubing 208 of FIG. 2) at a plurality of locations to separate one or more subsections of tubing (e.g., the two subsections of tubing 302 of FIG. 3A, the one subsection of tubing of FIG. 3B, or the three subsections of tubing 302 of FIG. 3C) from the tubing holder 200.

Thus, the traction wheel 400 and the particular cutting wheel assembly (e.g., the first cutting wheel assembly 510, the second cutting wheel assembly 512, or the third cutting wheel assembly 514) may operate cooperatively to separate one or more subsections of tubing 302 from the tubing holder 200.

Figure 9:
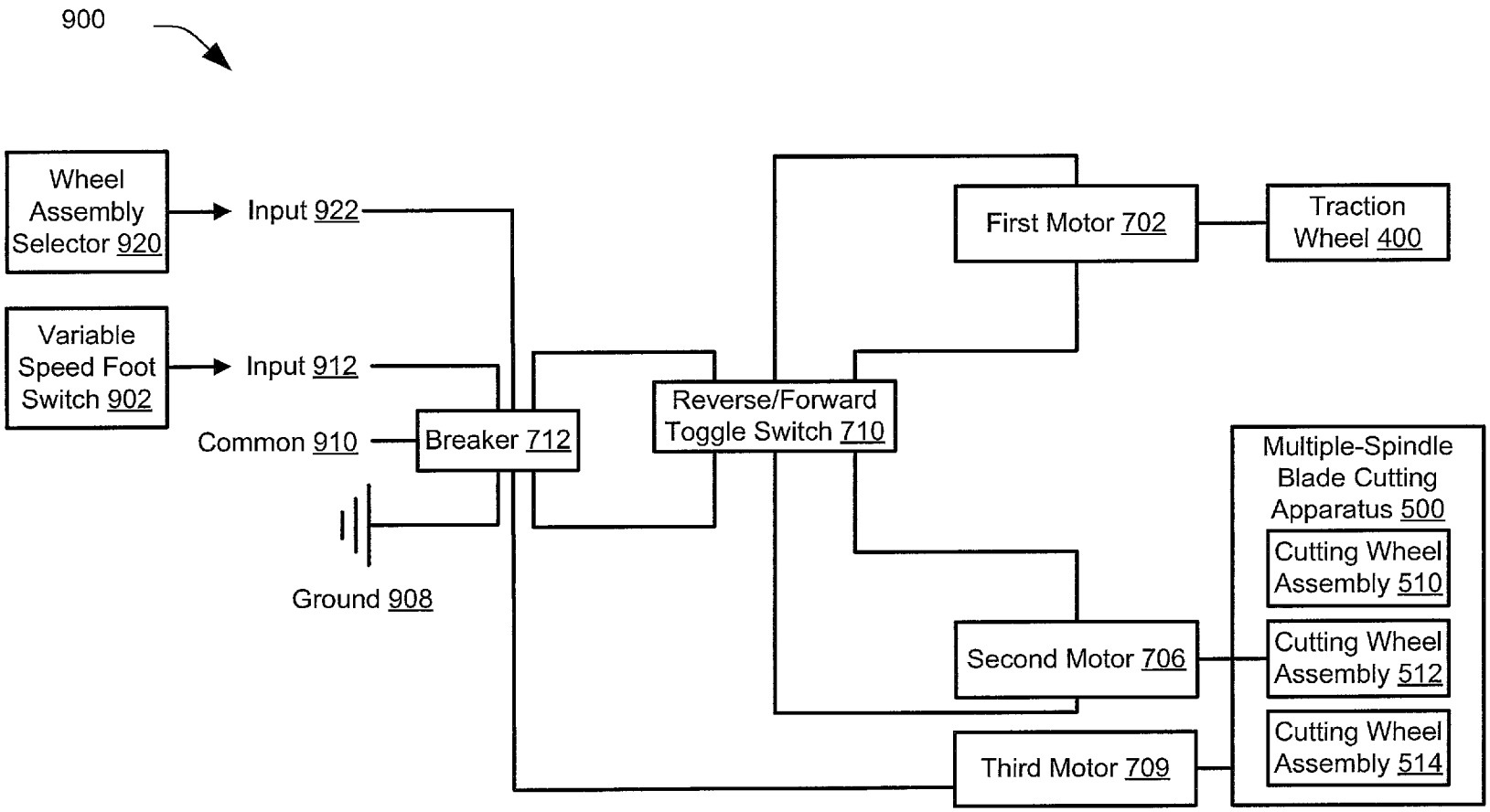
FIG. 9 is a diagram of another particular embodiment of a system to separate tubing sleeves from a tubing holder.

Referring to FIG. 9, a diagram of another particular embodiment of a system to separate tubing sleeves from a tubing holder is shown and is generally designated 900. The system 900 includes a variable speed foot switch 902 coupled to a first motor 702 and to a second motor 706, via a reverse/forward toggle switch 710 and a breaker 712. The breaker 712 is also coupled to ground 908, to a common line 910, and to the third motor 709. The reverse/forward toggle switch 710 is coupled, via the first motor 702, to the traction wheel 400. In addition, the reverse/forward toggle switch 710 is coupled, via the second motor 706, to the particular cutting wheel assembly of the multiple-spindle blade cutting apparatus 500 (e.g., the first cutting wheel assembly 510, the second cutting wheel assembly 512, or the third cutting wheel assembly 514). The third motor 709 is coupled to the multiple-spindle blade cutting apparatus 500 (e.g., via the spindle engagement hole 508 shown in FIG. 5A and FIG. 8B). While FIG. 9 illustrates an example in which the second cutting wheel assembly 512 is selected/engaged for rotation via the second motor 706, it will be appreciated that is for illustrative purposes only. For example, an operator may use a wheel assembly selector 920 to provide an input 922, and the third motor 709 may rotate the multiple-spindle blade cutting apparatus 500 (e.g., via the spindle engagement hole 508 shown in FIGS. 5A and 8B) in order to select/engage another cutting wheel assembly for rotation via the second motor 706. To illustrate, upon rotation of the multiple-spindle blade cutting apparatus 500 by the third motor 709 to select/engage another cutting wheel assembly, the second motor 706 may be coupled to the first cutting wheel assembly 510 or to the third cutting wheel assembly 514.

During operation, an operator may activate the variable speed foot switch 902. For example, the operator may use a foot to depress the variable speed foot switch 902. Upon activation, the variable speed foot switch 902 may send an input 912 to a motor (e.g., the first motor 702, the second motor 706, or both).

In a particular embodiment, the motor (e.g., the first motor 702, the second motor 706, or both) may operate for a particular time duration each time the variable speed foot switch 902 is activated. For example, the first motor 702 may rotate the traction wheel 400 during the particular time duration to advance the tubing holder 200 by a particular distance in response to the input 912. A plurality of sections of tubing may be coupled at intervals along a spine of the tubing holder. The particular distance that the tubing holder 200 is advanced may correspond to one interval. The traction wheel 400 may advance the tubing holder 200 by one section of tubing. Thus, pressing the variable speed foot switch 902 once may provide input (e.g., the input 912) to advance the tubing holder 200 by one interval and to cut one tubing section (e.g., the tubing section 208 of FIG. 2) into one or more subsections (e.g., the two subsections of tubing 302 of FIG. 3A, the one subsection of tubing 302 of FIG. 3B, or the three subsections of tubing 302 of FIG. 3C).

In an alternative embodiment, the motor (e.g., the first motor 702, the second motor 706, or both) may operate substantially continuously while the variable speed foot switch 902 is activated. In this embodiment, a speed of the motor (e.g., the first motor 702, the second motor 706, or both) may be responsive to a distance that the variable speed foot switch 902 is depressed. A value of the input 912 may vary based on the distance that the variable speed foot switch 902 is depressed. For example, the input 912 may have a first value when the variable speed foot switch is depressed a first distance and may have a second value (e.g., a larger value) when the variable speed foot switch is depressed a greater distance. The motor (e.g., the first motor 702, the second motor 706, or both) may have a lower speed in response to receiving the first value of the input 912, as compared to receiving the second value of the input 912. The speed of the first motor 702 may control a speed of rotation of the traction wheel 400 and the speed of the second motor 706 may control a speed of rotation of the particular cutting wheel assembly (e.g., the first cutting wheel assembly 510, the second cutting wheel assembly 512, or the third cutting wheel assembly 514). Hence, the speed of rotation of the traction wheel 400, the particular cutting wheel assembly, or both, may be responsive to the input 912.

Although the input 912 is described herein in terms of values, in a particular embodiment the input 912 may be electromechanical. For example, depressing the variable speed foot switch 902 may activate a switch that provides power to a motor (e.g., the first motor 702, the second motor 706, or both) for a predetermined time or number of revolutions of the motor. As another example, depressing the variable speed foot switch 902 may activate a variable resistor to control speed by changing voltage provided to a motor (e.g., the first motor 702, the second motor 706, or both).

In a particular embodiment, the input 912 may be received by the motor (e.g., the first motor 702, the second motor 706, or both) via the breaker 712 and via the reverse/forward toggle switch 710. If a current received by the breaker 712 exceeds a first threshold, the breaker 712 may interrupt the current to protect the system 900 from overload. The reverse/forward toggle switch 710 may control a direction of rotation of a motor (e.g., the first motor 702, the second motor 706, or both). For example, when the reverse/forward toggle switch 710 is in a first position (e.g., "up"), the direction of rotation of the motor (e.g., the first motor 702, the second motor 706, or both) may be forward, and when the reverse/forward toggle switch 710 is in a second position (e.g., "down"), the direction of rotation of the motor (e.g., the first motor 702, the second motor 706, or both) may be reversed. The direction of rotation of the first motor 702 may control a direction of rotation of the traction wheel 400, and the direction of rotation of the second motor 706 may control a direction of rotation of the particular cutting wheel assembly (e.g., the first cutting wheel assembly 510, the second cutting wheel assembly 512, or the third cutting wheel assembly 514). A first direction of rotation of the traction wheel 400 may advance a tubing holder (e.g., the tubing holder 200) towards the particular cutting wheel assembly, and a second direction of the traction wheel 400 may move the tubing holder 200 away from the particular cutting wheel assembly.

In a particular embodiment, the first motor 702, the second motor 706, or both, may include a single phase, 115 volts alternating current (VAC), 50/60 hertz (Hz) motor. In a particular embodiment, the third motor 709 may include a single phase, 115 VAC, 50/60 Hz motor. In a particular embodiment, a diameter of the traction wheel 400 may be approximately 2.87 measurement units. As a result, an arc length of the traction wheel 400 may be approximately 9.02 measurement units (i.e., $\pi$*diameter). The traction wheel 400 may have a maximum speed of 100 rotations per minute (RPM). Hence, the tubing holder 200 may advance a maximum of approximately 902 measurement units per minute (i.e., arc length*speed). In a particular embodiment, a diameter of the particular cutting wheel assembly may be approximately 0.98 measurement units. As a result, an arc length of the particular cutting wheel assembly may be approximately 3.10 measurement units (i.e., $\pi$*diameter). The particular cutting wheel assembly may have a maximum speed of 200 RPM. Hence, the particular cutting wheel assembly may process a maximum of approximately 620 measurement units of the tubing holder 200 per minute.

Thus, the traction wheel 400 and the particular cutting wheel assembly (e.g., the first cutting wheel assembly 510, the second cutting wheel assembly 512, or the third cutting wheel assembly 514) may cooperatively process the tubing holder 200 and separate tubing sleeves from the tubing holder 200. Automatic separation of the tubing sleeves may reduce cost and increase efficiency associated with separating the tubing sleeves.

Figure 10:
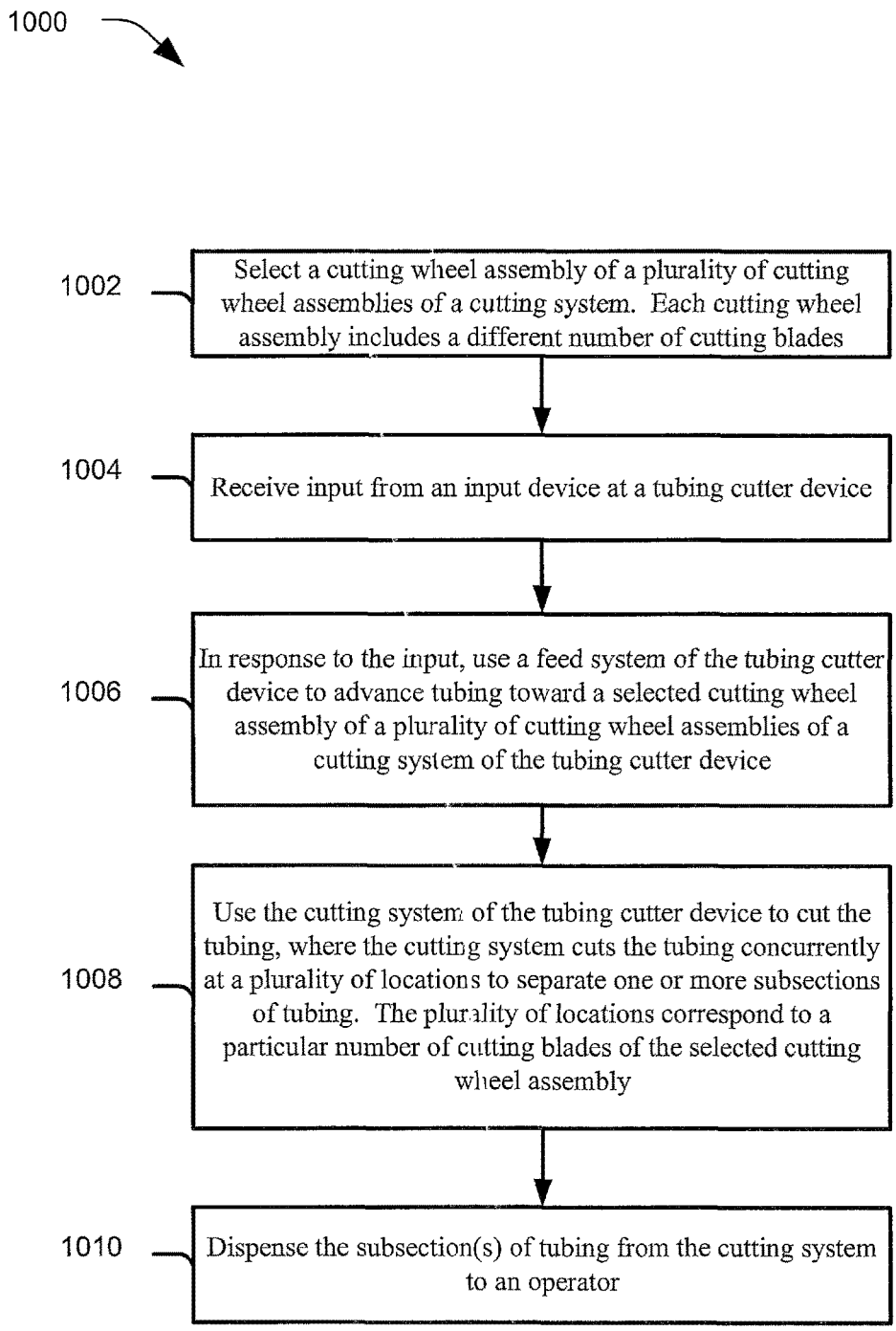
FIG. 10 is a flow chart illustrating a particular embodiment of a method of separating tubing sleeves from a tubing holder.

Referring to FIG. 10, a flow chart of a particular illustrative embodiment of a method of separating subsection(s) of tubing (e.g., tubing sleeves from a tubing holder) is shown and is generally designated 1000. The method 1000 of FIG. 10 may be executed by the system 100 of FIG. 1, the apparatus 700 of FIG. 7, the system 900 of FIG. 9, or a combination thereof.

The method 1000 includes selecting a cutting wheel assembly of a plurality of cutting wheel assemblies, at 1002. Each cutting wheel assembly includes a different number of cutting blades. For example, referring to FIG. 5A, the spindle engagement hole 508 of the multiple-spindle blade cutting apparatus 500 may be used to select a particular cutting wheel assembly (e.g., the first cutting wheel assembly 510 illustrated in FIG. 6A, the second cutting wheel assembly 512 illustrated in FIG. 6B, or the third cutting wheel assembly 514 illustrated in FIG. 6C). In a particular embodiment, an electric motor of the apparatus 700 of FIG. 7 (e.g., the third motor 709) may rotate the multiple-spindle blade cutting apparatus 500 to select a particular cutting wheel assembly by engaging the spindle engagement hole 508. Alternatively, a particular cutting wheel assembly may be engaged/selected using a non-electric motor, a hand crank, etc. to rotate the multiple-spindle blade cutting apparatus 500 in order to select a particular cutting wheel assembly with a particular number of cutting blades (e.g., two, three, or four cutting blades).

The method 1000 may include receiving input from an input device at a tubing cutter device, at 1004. For example, the apparatus 700 of FIG. 7 may receive an input (e.g., the input 912) from the variable speed foot switch 902. In a particular embodiment, the input device may include a switch, a computing device, a handheld device, a mobile device, or a combination thereof.

The method 1000 may also include, in response to the input, using a feed system of the tubing cutter device to advance tubing toward a cutting system of the tubing cutter device, at 1006. As an example, the method 1000 may include using the feed system of the tubing cutter device to advance a tubing holder by a distance toward the cutting system of the tubing cutter device. A plurality of sections of tubing may be coupled at intervals along a first spine of the tubing holder. Each of the plurality of sections of tubing may extend away from the first spine in a direction that is transverse to a feed direction of the feed system. For example, the apparatus 700 may use the traction wheel 400 of FIG. 4 to advance the tubing holder 200 by a particular distance toward the particular cutting wheel assembly (e.g., the first cutting wheel assembly 510, the second cutting wheel assembly 512, or the third cutting wheel assembly 514). A plurality of sections of tubing may be coupled at intervals along the first spine 202 of the tubing holder 200. The particular distance may correspond to one interval.

The method 1000 may further include using the cutting system of the tubing cutter device to cut the tubing, at 1008. The cutting system may cut the tubing concurrently at a plurality of locations to separate one or more subsections of tubing. The plurality of locations correspond to a particular number of cutting blades of the selected cutting wheel assembly. As an example, the method 1000 may include using the cutting system to cut a first section of tubing at a plurality of locations to separate one or more subsections of the first section of tubing. For example, the apparatus 700 may use the first cutting wheel assembly 510 (see FIG. 6A) to cut the section of tubing 208 of FIG. 2 at three locations to separate the three subsections of tubing 302 of FIG. 3A from the tubing holder 200. As another example, the apparatus 700 may use the second cutting wheel assembly 512 (see FIG. 6B) to cut the section of tubing 208 of FIG. 2 at two locations to separate the subsection of tubing 302 of FIG. 3B from the tubing holder 200. As a further example, the apparatus 700 may use the third cutting wheel assembly 514 (see FIG. 6C) to cut the section of tubing 208 of FIG. 2 at four locations to separate the three subsections of tubing 302 of FIG. 3C from the tubing holder 200.

The method 1000 may also include dispensing the one or more subsections of tubing from the cutting system to an operator, at 1010. In cases where multiple subsections of tubing are dispensed, the subsections may be dispensed from the cutting system to the operator substantially simultaneously. For example, when the first cutting wheel assembly 510 (see FIG. 6A) is used, the apparatus 700 may dispense, substantially simultaneously with one another, the three subsections of tubing 302 (see FIG. 3A) from the first cutting wheel assembly 510 to an operator. As another example, when the second cutting wheel assembly 512 (see FIG. 6B) is used, the apparatus 700 may dispense one subsection of tubing 302 (see FIG. 3B) to an operator. As a further example, when the third cutting wheel assembly 514 (see FIG. 5C) is used, the apparatus 700 may dispense the three subsections of tubing 302 (see FIG. 3C) to an operator.

While not shown in FIG. 10, in some cases, the method 1000 may further include reversing a feed direction of the feed system. To illustrate, the feed direction of the feed system may be reversed to remove the tubing holder in response to activation of a toggle switch. For example, the apparatus 700 of FIG. 7 may reverse the feed direction of the traction wheel 400 to remove the tubing holder 200 in response to activation of the reverse/forward toggle switch 710 of FIG. 7.

Thus, the method 1000 may be used to separate subsection(s) of tubing (e.g., tubing sleeves from a tubing holder). For example, each of the subsection(s) of tubing 302 may correspond to a heat shrink tubing sleeve. The apparatus 700 may separate the tubing sleeves from the tubing holder 200 by using the traction wheel 400 to advance the tubing holder 200 to the particular cutting wheel assembly (e.g., the first cutting wheel assembly 510, the second cutting wheel assembly 512, or the third cutting wheel assembly 514) and by using the particular cutting wheel assembly to cut the section of tubing 208 at a plurality of locations. The tubing sleeves may be dispensed to an operator. Automatic separation of the tubing sleeves from the tubing holder may reduce cost and increase efficiency associated with using the tubing sleeves.

Figure 11:
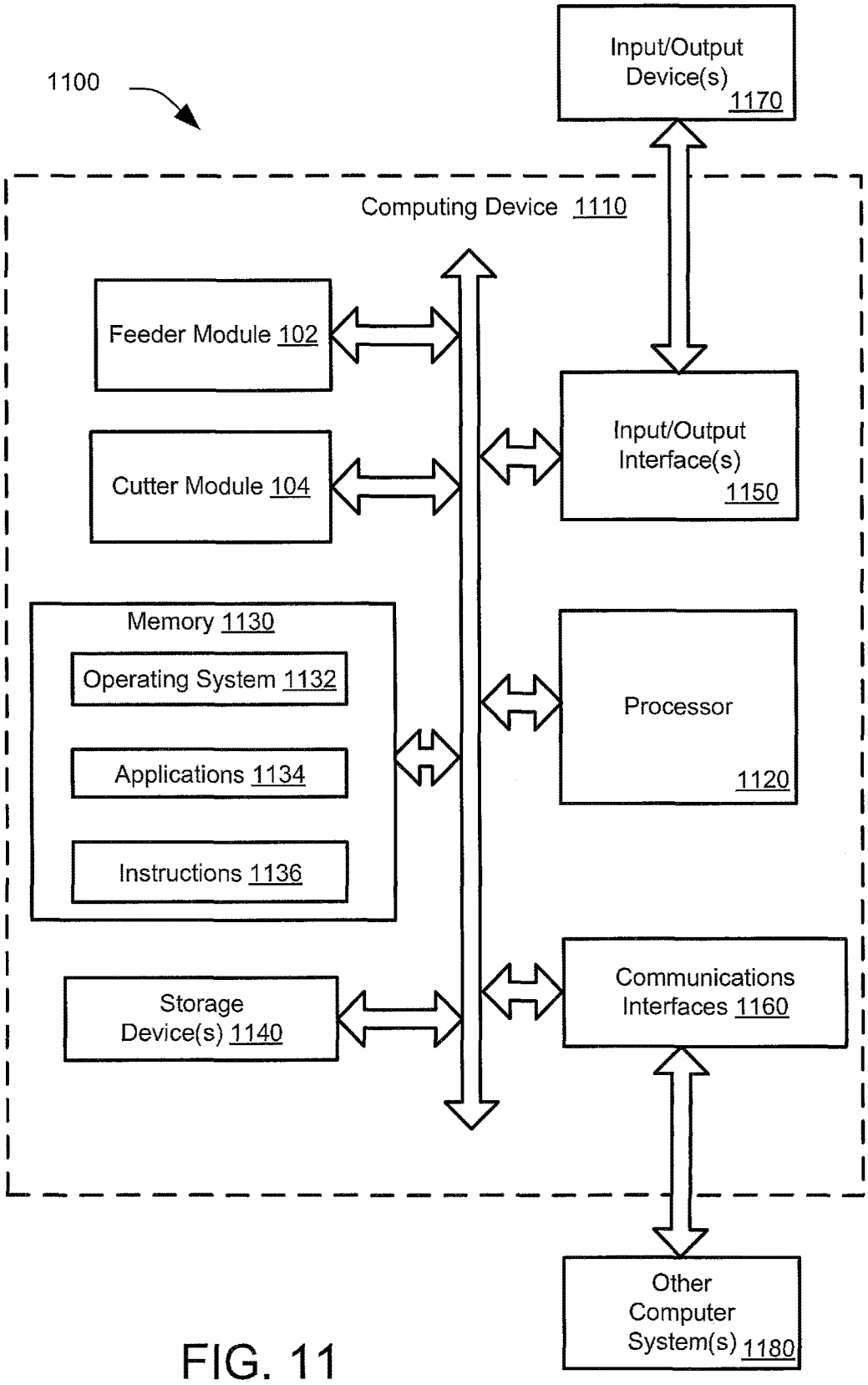
FIG. 11 is a block diagram of a particular illustrative embodiment of a computing environment to separate tubing sleeves from a tubing holder.

FIG. 11 is a block diagram of a computing environment 1100 including a general purpose computing device 1110 to support embodiments of computer-implemented methods and computer-executable program instructions (or code) according to the present disclosure. For example, the computing device 1110, or portions thereof, may execute instructions to control a tubing cutter apparatus to separate tubing sleeves from a tubing holder. As another example, the computing device 1110, or portions thereof, may execute instructions to use a feed system to feed a tubing holder toward a cutting system and to use the cutting system to cut a first section of tubing at a plurality of locations to separate one or more subsections of tubing (e.g., one, two, or three subsections of tubing, among other alternatives). In a particular embodiment, the computing device 1110 may include, be included with, or correspond to the system 100 of FIG. 1, the apparatus 700 of FIG. 7, the system 900 of FIG. 9, or a combination thereof.

The computing device 1110 may include a processor 1120. Within the computing device 1110, the processor 1120 may communicate with the feeder module 102 of FIG. 1, the cutter module 104 of FIG. 1, memory 1130, one or more storage devices 1140, one or more input/output interfaces 1150, one or more communications interfaces 1160, or a combination thereof.

The memory 1130 may include volatile memory devices (e.g., random access memory (RAM) devices), nonvolatile memory devices (e.g., read-only memory (ROM) devices, programmable read-only memory, and flash memory), or both. The memory 1130 may include an operating system 1132, which may include a basic/input output system for booting the computing device 1110 as well as a full operating system to enable the computing device 1110 to interact with users, other programs, and other devices. The memory 1130 may include one or more application programs 1134, such as a tubing sleeve separating system control application, e.g., an application that is executable to control a tubing cutter apparatus to separate tubing sleeves from a tubing holder. The memory 1130 may include instructions 1136 that are executable by the processor 1120, e.g., instructions that are executable to control a tubing cutter apparatus to separate tubing sleeves from a tubing holder. In some cases, the memory 1130 may include instructions 1136 that are executable by the processor 1120 to control a tubing cutter apparatus to selectively engage a particular cutting wheel assembly of a plurality of cutting wheel assemblies (e.g., for cutting one, two, or three subsections of tubing, among other alternatives).

The processor 1120 may also communicate with one or more storage devices 1140. For example, the one or more storage devices 1140 may include nonvolatile storage devices, such as magnetic disks, optical disks, or flash memory devices. The storage devices 1140 may include both removable and non-removable memory devices. The storage devices 1140 may be configured to store an operating system, applications, and program data. In a particular embodiment, the memory 1130, the storage devices 1140, or both, include tangible, non-transitory computer-readable media.

The processor 1120 may also communicate with one or more input/output interfaces 1150 that enable the computing device 1110 to communicate with one or more input/output devices 1170 to facilitate user interaction. For example, the one or more input/output devices 1170 may include the variable speed foot switch 902 of FIG. 9 and the wheel assembly selector 920 of FIG. 9, among other alternatives. The input/output interfaces 1150 may include serial interfaces (e.g., universal serial bus (USB) interfaces or Institute of Electrical and Electronics Engineers (IEEE) 11094 interfaces), parallel interfaces, display adapters, audio adapters, and other interfaces. The input/output devices 1170 may include keyboards, pointing devices, displays, speakers, microphones, touch screens, and other devices. The processor 1120 may detect interaction events based on user input received via the input/output interfaces 1150. Additionally, the processor 1120 may send a display to a display device via the input/output interfaces 1150.

The processor 1120 may communicate with other computer systems 1180 via the one or more communications interfaces 1160. The one or more communications interfaces

1160 may include wired Ethernet interfaces, IEEE 802 wireless interfaces, Bluetooth communication interfaces, or other network interfaces. The other computer systems 1180 may include host computers, servers, workstations, and other computing devices.

Thus, in particular embodiments, a computer system may be able to control a tubing cutter apparatus to separate tubing sleeves from a tubing holder. For example, the instructions 1136 may be executable by the processor 1120 to use a feed system to feed a tubing holder toward a cutting system and to use the cutting system to cut a first section of tubing at a plurality of locations to separate one or more subsections of tubing.

Embodiments described above are illustrative and do not limit the disclosure. It is to be understood that numerous modifications and variations are possible in accordance with the principles of the present disclosure.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. For example, method steps may be performed in a different order than is shown in the figures or one or more method steps may be omitted. Accordingly, the disclosure and the figures are to be regarded as illustrative rather than restrictive.

Moreover, although specific embodiments have been illustrated and described herein, it is to be appreciated that any subsequent arrangement designed to achieve the same or similar results may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, the claimed subject matter may be directed to less than all of the features of any of the disclosed embodiments.

What is claimed is:

1. A method comprising:

selecting a cutting wheel assembly of a plurality of cutting wheel assemblies of a cutting system, wherein each cutting wheel assembly includes a different number of cutting blades;

using a feed system to feed tubing toward the cutting system, the tubing including a plurality of sections of tubing coupled at intervals along a first spine of a tubing holder, each of the plurality of sections of tubing extending away from the first spine in a direction transverse to a feed direction of the feed system; and using the cutting system to cut the tubing, wherein the cutting system cuts the tubing concurrently at a plurality of locations to separate one or more subsections of tubing, the plurality of locations corresponding to a particular number of cutting blades of the selected cutting wheel assembly.

2. The method of claim 1, wherein each of the plurality of sections of tubing is attached, prior to cutting, at a first end to the first spine and at a second end to a second spine of the tubing holder.

3. The method of claim 2, wherein each of the plurality of sections of tubing is attached, prior to the cutting, to the first spine and to the second spine using an adhesive tape.

4. The method of claim 2, wherein the plurality of locations includes three locations, and wherein the one or more subsections of tubing includes two subsections that are separated from the first spine and the second spine.

5. The method of claim 2, wherein the plurality of locations includes two locations, and wherein the one or more subsections of tubing include one subsection that is separated from the first spine and the second spine.

6. The method of claim 2, wherein the plurality of locations includes four locations, and wherein the one or more subsections of tubing include three subsections that are separated from the first spine and the second spine.

7. The method of claim 1, wherein the one or more subsections include a plurality of subsections, the method further comprising dispensing, concurrently with one another, the plurality of subsections from the cutting system to an operator, and wherein each of the plurality of subsections includes a wire designation marking for a particular wire.

8. A method comprising:

using a feed system of a tubing cutter device to advance tubing by a distance toward a selected cutting wheel assembly of a plurality of cutting wheel assemblies of a cutting system of the tubing cutter device, the tubing including a plurality of sections of tubing coupled at intervals along a first spine of a tubing holder, each of the plurality of sections of tubing extending away from the first spine in a direction transverse to a feed direction of the feed system; and using the cutting system of the tubing cutter device to cut the tubing, wherein the cutting system cuts the tubing concurrently at a plurality of locations to separate one or more subsections of tubing, the plurality of locations corresponding to a particular number of cutting blades of the selected cutting wheel assembly of the plurality of cutting wheel assemblies.

9. The method of claim 8, further comprising:

receiving input from an input device at the tubing cutter device; and dispensing the one or more subsections of tubing from the cutting system to an operator.

10. The method of claim 9, wherein the tubing includes a plurality of sections of tubing that are coupled at intervals along a first spine of a tubing holder, wherein the distance corresponds to one interval, and wherein each of the plurality of sections of tubing extends away from the first spine in a direction that is transverse to a feed direction of the feed system.

11. The method of claim 10, further comprising, in response to activation of a toggle switch, reversing the feed direction of the feed system to remove the tubing holder.

12. The method of claim 9, wherein each of the one or more subsections of tubing includes a heat shrink tubing sleeve and wherein each of the one or more subsections of tubing includes wire designation markings for a particular wire.

13. The method of claim 9, wherein the input device includes a variable speed foot switch, and wherein a speed of rotation of a traction wheel of the feeding system is controlled responsive to the variable speed foot switch.

* * * * *